US011672401B2

(12) United States Patent
Woo et al.

(10) Patent No.: US 11,672,401 B2
(45) Date of Patent: Jun. 13, 2023

(54) AUTOMATIC CLEANING FILTER AND DISHWASHER EQUIPPED WITH THE SAME

(71) Applicant: LG Electronics Inc., Seoul (KR)

(72) Inventors: Sang Woo Woo, Seoul (KR); Byeong Hyeon Ju, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/362,235

(22) Filed: Jun. 29, 2021

(65) Prior Publication Data

US 2021/0401258 A1 Dec. 30, 2021

(30) Foreign Application Priority Data

Jun. 29, 2020 (KR) ..... 10-2020-0079621

(51) Int. Cl.
*A47L 15/42* (2006.01)

(52) U.S. Cl.
CPC ..... *A47L 15/4208* (2013.01); *A47L 15/4206* (2013.01); *A47L 15/4225* (2013.01); *A47L 15/4219* (2013.01)

(58) Field of Classification Search
None
See application file for complete search history.

(56) References Cited

U.S. PATENT DOCUMENTS

| | | | | |
|---|---|---|---|---|
| 8,707,973 | B2 | 4/2014 | Yoon et al. | |
| 9,375,129 | B2 | 6/2016 | Welch | |
| 2006/0237050 | A1 | 10/2006 | Weaver et al. | |
| 2013/0319485 | A1* | 12/2013 | Blanchard | A47L 15/4219 134/110 |

FOREIGN PATENT DOCUMENTS

| | | |
|---|---|---|
| EP | 2671495 | 12/2013 |
| KR | 101669282 | 10/2016 |
| WO | WO2019168379 | 9/2019 |

OTHER PUBLICATIONS

Extended European Search Report in European Appln. No. 21182176.4, dated Nov. 26, 2021, 7 pages.

* cited by examiner

*Primary Examiner* — Levon J Shahinian
(74) *Attorney, Agent, or Firm* — Fish & Richardson P.C.

(57) ABSTRACT

The present disclosure relates to a dishwasher equipped with an automatic cleaning filter including a tub 12 provided with a washing space 12*a* that accommodates cooking vessels, a sump 100 disposed under the washing space 12*a* and configured to store a washing liquid, an automatic cleaning filter 200 disposed in the sump 100, and a washing pump 150 connected to the sump 100 and configured to re-circulate a washing liquid. The automatic cleaning filter 200 includes a rotating filter 210, an inlet guide 220, a filter housing 230, and a driver 270. The rotating filter 210 includes a plurality of first holes 213 and a lateral surface portion 212 surrounding a predetermined vacant space. The inlet guide 220 includes a first outlet 224 which discharges the washing liquid including foreign substances into the rotating filer 210.

20 Claims, 25 Drawing Sheets

AUTOMATIC CLEANING FILTER AND DISHWASHER EQUIPPED WITH THE SAME

CROSS-REFERENCE TO RELATED APPLICATION

This application claims priority to and the benefit of Korean Patent Application No. 10-2020-0079621, filed on Jun. 29, 2020, the disclosure of which is incorporated herein by reference in its entirety.

BACKGROUND

1. Field of the Disclosure

Disclosed herein are an automatic cleaning filter and a dishwasher equipped with the same, and specifically, an automatic cleaning filter and a dishwasher equipped with the same in which with a simple configuration, the filter is automatically, effectively and readily cleaned without incurring large costs.

2. Description of Related Art

Dishwashers are home appliances that spray a washing liquid to an object to be washed such as a cooking vessel or a cook tool and the like to remove foreign substances left in the object to be washed.

A dishwasher includes a tub providing a washing space, a rack disposed in the tub and accommodating cooking vessels and the like, a spray arm spraying a washing liquid to the rack, a sump storing a washing liquid, and a washing pump supplying the washing liquid stored in the sump to the spray arm.

While cooking vessels are washed, a washing liquid can be reused. Specifically, a clean washing liquid is supplied to the sump to wash cooking vessels and the like, and then the washing liquid used for washing is returned along with foreign substances to the sump. The returned washing liquid can be used again as a washing liquid after passing through a filtering device in the sump.

In this case, foreign substances are accumulated in the filter device. Accordingly, the filter device is blocked by the foreign substances. Thus, flow resistance can increase when a washing liquid is supplied, the washing pump can be overloaded, a flow rate and a flow velocity of a washing liquid passing through the filter device can be reduced and washing performance of the dishwasher can deteriorate.

As a means to solve the problems, a dishwasher of the related art is described hereunder.

A dishwasher is disclosed in Korean Patent No. 10-1669282. The dishwasher includes a washing space including a rack configured to store cooking vessels and a nozzle configured to spray a washing liquid; a sump in which the washing liquid supplied to the washing space is collected; a filter disposed in the sump and configured to filter foreign substances from the washing liquid; a rotating part configured to rotate in a way that can contact the filter, and provided with a blade for cleaning foreign substances; a driver configured to supply a driving force to the rotating part; and a rotating shaft detachably coupled to the rotating part and provided with a holding jaw selectively held by the rotating part.

In the related art, the blade or the filter is worn away, and when the blade contacts the filter, pressure is applied to foreign substances. Accordingly, the foreign substances can be cut, fine dust can increase, and the foreign substances can be fixed to the filter.

RELATED ART DOCUMENT

[Patent Document]

(Patent Document 001) Korean Patent No. 10-1669282

SUMMARY OF THE DISCLOSURE

The present disclosure describes a dishwasher which may have a simple structure, incur low costs and automatically, effectively, readily clean a filter.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

To solve the above problems, provided is a dishwasher including: a tub 12 defining a washing space 12*a* configured to accommodate a cooking vessel; a sump 100 disposed under the washing space 12*a* and configured to receive a washing liquid; an automatic cleaning filter 200 disposed in the sump 100; and a washing pump 150 connected to the sump 100 and configured to supply the washing liquid to a plurality of spray arms.

The automatic cleaning filter 200 may include a rotating filter 210, an inlet guide 220, a filter housing 230 and a driver 270.

The rotating filter 210 may define a plurality of first holes 213 and may have a lateral surface portion 212 that surrounds a predetermined vacant space defined within the rotating filter.

The inlet guide 220 may include a first inlet 222 configured to receive the washing liquid including foreign substances, a first outlet 224 in fluid communication with the first inlet 222 and that discharges the washing liquid including foreign substances into the rotating filter 210, and a body 226 connecting the first inlet 222 and the first outlet 224.

The filter housing 230 may be disposed outside the rotating filter 210, wherein the filter housing may include a housing wall 232 surrounding the lateral surface portion 212 of the rotating filter 210, and a second outlet 234 that passes through the housing wall 232 from which the washing liquid is discharged, wherein the rotating filter 210 is configured to filter the foreign substances in the washing liquid.

The driver 270 may rotate the rotating filter 210.

The rotating filter 210 may rotate in a first direction with respect to the inlet guide 220 and the filter housing 230.

The first outlet 224 may be configured to direct the washing liquid toward a part of an inner circumferential surface of the lateral surface portion 212 in a predetermined direction.

A horizontal component of the predetermined direction and a horizontal component of a direction from the first outlet 224 to the second outlet 234 may form a predetermined angle greater than 0 degrees.

In one embodiment, the predetermined angle may be greater than 90 degrees.

In one embodiment, the predetermined angle may be 180 degrees.

In one embodiment, the first outlet 224 may be disposed adjacent to the part of the inner circumferential surface of the lateral surface portion 212.

In one embodiment, the rotating filter 210 may rotate around a rotation axis A extended in a vertical direction, and the first outlet 224 may be disposed in a direction opposite to a direction of the second outlet 234 with respect to the rotation axis A.

In one embodiment, the body 226 and the first outlet 224 of the inlet guide 220 may be at least partially disposed inside the rotating filter 210, and the first outlet 224 may be elongated along a vertical direction and may be configured to direct the washing liquid toward the inner circumferential surface of the lateral surface portion 212.

In one embodiment, the housing wall 232 of the filter housing 230 may be disposed a predetermined distance apart from an outer circumferential surface of the lateral surface portion 212 of the rotating filter 210 and may be disposed outside the rotating filter 210 along the outer circumferential surface of the lateral surface portion 212 of the rotating filter 210.

In one embodiment, the predetermined vacant space inside the rotating filter 210 may be divided into a first area a1 and a second area a2 with respect to a virtual partition P that is elongated along a vertical direction and connects the part of the inner circumferential surface of the rotating filter 210 and the second outlet 234.

In the first area a1, at least a first portion of the washing liquid including foreign substances may flow along the inner circumferential surface of the lateral surface portion 212 in a direction the same as a direction of rotation of the rotation filter 210.

In the second area a2, at least a second portion of the washing liquid including foreign substances may flow along the inner circumferential surface of the lateral surface portion 212 in a direction opposite to the direction of rotation of the rotating filter 210.

A flow partition 260 including a first side portion 262*a* facing the first area a1 and a second side portion 262*b* facing the second area a2 may be disposed between the first area a1 and the second area a2.

In one embodiment, the flow partition 260 may be disposed at a position within the predetermined vacant space or has a predetermined shape, and the second area a2 may be greater than the first area a1.

In one embodiment, the first side portion 262*a* may protrude in an outward direction toward the first area.

In one embodiment, the first side portion 262*a* may be disposed a predetermined distance apart from the inner circumferential surface of the lateral surface portion 212 of the rotating filter 210 along the inner circumferential surface of the lateral surface portion 212 of the rotating filter 210 and may be disposed inside the rotating filter 210.

In one embodiment, the second side portion 262*b* may include a section in which a distance from the lateral surface portion 212 of the rotating filter 210, surrounding the second area a2, increases and then decreases toward the first outlet 224 or the second outlet 234.

In one embodiment, the second side portion 262*b* may include a flat surface disposed in parallel with the virtual partition P.

In one embodiment, a portion of the flow partition 260, facing the second outlet 234, may be configured to cover the second outlet 234 entirely.

In one embodiment, the body 226 and the first outlet 224 of the inlet guide 220 may be at least partially disposed inside the rotating filter 210.

The body 226 may be elongated toward the second outlet 234, and accordingly, a vacant space in the body 226 connecting the first inlet 222 and the first outlet 224 may extend toward the second outlet 234.

The body 226 may correspond to the flow partition 260.

In one embodiment, the first inlet 222 of the inlet guide 220 may be disposed at an upper portion of the body 226 to face an upward direction, and a filter 250 may be disposed on top of the first inlet 222.

The filter 250 may include a plurality of second holes 252 having a diameter greater than a diameter of a first hole 213 of the plurality of first holes formed in the rotating filter 210.

In one embodiment, a washing nozzle 242 configured to spray the washing liquid toward the rotating filter 210 may be disposed on the housing wall 232.

In one embodiment, the washing nozzle 242 may be disposed to face the first outlet 224, and may spray a washing liquid in a direction opposite to the predetermined direction faced by the first outlet 224.

In one embodiment, the washing nozzle 242 may be elongated along a vertical direction and may be disposed at the outer circumferential surface of the lateral surface portion 212.

In one embodiment, the filter housing 230 may correspond to the sump 100.

Advantageous Effect

In embodiments, a dishwasher equipped with an automatic cleaning filter may include a tub 12 provided with a washing space 12*a* that accommodates cooking vessels; a sump 100 disposed under the washing space 12*a* and configured to store a washing liquid; an automatic cleaning filter 200 disposed in the sump 100; and a washing pump 150 connected to the sump 100 and configured to re-circulate a washing liquid. The automatic cleaning filter 200 may include a rotating filter 210, an inlet guide 220, a filter housing 230 and a driver 270. The rotating filter 210 may include a plurality of first holes 213 and a lateral surface portion 212 surrounding a predetermined vacant space. The inlet guide 220 may include a first outlet 224 which discharges the washing liquid including foreign substances into the rotating filer 210. The filter housing 230 may be disposed outside the rotating filter 210, and may include a second outlet 234 configured to discharge a washing liquid, from which foreign substances are filtered by the rotating filter 210. The rotating filter 210 may rotate in one direction with respect to the inlet guide 220 and the filter housing 230. The first outlet 224 may be formed toward a part of an inner circumferential surface of the lateral surface portion 212 in a predetermined direction, and a horizontal component of the predetermined direction and a horizontal component of a direction from the first outlet 224 to the second outlet 234 may form a predetermined angle greater than 0 degrees. Accordingly, in a portion where a direction in which the rotating filter 210 rotates is opposite to a direction in which a washing liquid including foreign substances flows along the inner circumferential surface of the lateral surface portion 212 of the rotating filter 210, a strong shear force may be applied to the inner circumferential surface of the lateral surface portion 212, and foreign substances s adhered to the lateral surface portion 212 may easily separate from the lateral surface portion 212. With the simple configuration, the filter may be cleaned automatically and effectively without incurring large costs. Thus, flow resistance may be reduced and energy efficiency may improve since the filter is not blocked by foreign substances. Further, the filter does not have to be cleaned manually, and costs incurred for managing and repairing the filter may be reduced. As a result of reduction in the flow resistance, durability of the dishwasher may improve. Additionally, since the filter is not blocked, a flow pressure and a flow rate of a washing liquid may not be reduced, thereby ensuring improvement in performance of the dishwasher, and the frequency or amount where a washing liquid used for removing foreign substances adhered to the filter are supplied and drained may be reduced, thereby reducing an amount of a washing liquid to be used. When the dishwasher heats a washing liquid and then uses the heated washing liquid, an amount of the washing liquid to be used may be reduced, and energy used for heating the washing liquid may be saved.

In the embodiments, the predetermined angle may be greater than 90 degrees. Accordingly, flow resistance may be reduced, and a distance at which a shear force is applied in a second area a2 may increase, thereby improving a cleaning effect of the automatic cleaning filter. With the simple configuration, the filter may be cleaned automatically and readily without incurring large costs.

In the embodiments, the predetermined angle may be 180 degrees. Accordingly, a washing liquid including foreign substances may uniformly flow, thereby suppressing generation of an eddy, and a distance moved by a washing liquid including foreign substances along the inner circumferential surface of the lateral surface portion 212 of the rotating filter 210 may increase. Thus, flow resistance may be reduced, and a distance at which a shear force is applied in the second area a2 may increase, thereby improving a cleaning effect of the automatic cleaning filter. With the simple configuration, the filter may be cleaned automatically and readily without incurring large costs.

In the embodiments, the first outlet 224 may be disposed near a part of the inner circumferential surface of the lateral surface portion 212 arranged in the predetermined direction which is faced by the first outlet 224 and in which the first outlet 224 is formed. Accordingly, a distance between a point, at which the washing liquid including foreign substances is discharged from the first outlet 224, and a point, at which the washing liquid including foreign substances is branched into two with respect to the horizontal component as a result of interference of a part of the inner circumferential surface of the lateral surface portion 212, may decrease. Thus, a flow rate and a flow velocity of the washing liquid with foreign substances, branched into two and flowing along the inner circumferential surface of the lateral surface portion 212, may increase, and a stronger shear force may be applied to the inner circumferential surface of the lateral surface portion 212, thereby separating foreign substances s adhered to the lateral surface portion 212 from the lateral surface portion 212 more readily and effectively, and generation of an eddy may be suppressed, thereby reducing flow resistance. With the simple configuration, the filter may be cleaned automatically and readily without incurring large costs.

In the embodiments, the first outlet 224 may be disposed in a direction opposite to a direction of the second outlet 234 with respect to a rotation axis A of the rotating filter 210. Accordingly, distances to be moved respectively by the washing liquid, which is branched into two with respect to the horizontal component as a result of interference by a part of the inner circumferential surface of the lateral surface portion 212 after the washing liquid including foreign substances is discharged from the first outlet 224, may become similar in order for the two branches of washing liquids to flow to the second outlet 234 along the inner circumferential surface of the lateral surface portion 212 and flow rates of the two branches of washing liquids may become similar. Thus, the washing liquid including foreign substances may flow uniformly and stably, thereby suppressing generation of an eddy and reducing flow resistance. With the simple configuration, the filter may be cleaned automatically and readily without incurring large costs.

In the embodiments, a body 226 and the first outlet 224 of the inlet guide 220 may be disposed at least partially inside the rotating filter 210, and the first outlet 224 may be formed in a way that the first outlet 224 is long in an up-down direction toward the inner circumferential surface of the lateral surface portion 212. Accordingly, a flow cross-sectional area, in which a washing liquid including foreign substances can flow, may increase, and flow resistance may decrease. Additionally, since the washing liquid with foreign substances, flowing along the inner circumferential surface of the lateral surface portion 212, flows stably in the up-down direction, foreign substances s adhered to the lateral surface portion 212 may separate from the lateral surface portion 212 more readily, and generation of an eddy may be suppressed, thereby reducing flow resistance. With the simple configuration, the filter may be cleaned automatically and effectively without incurring large costs.

In the embodiments, a housing wall 232 of the filter housing 230 may be spaced a predetermined distance apart from an outer circumferential surface of the lateral surface portion 212 of the rotating filter 210 and may be formed outside the rotating filter 210 along the outer circumferential surface of the lateral surface portion 212 of the rotating filter 210. Accordingly, a washing liquid, which flows between the housing wall 232 and the lateral surface portion 212 of the rotating filter 210 and from which foreign substances are filtered, may support the washing liquid with foreign substances, flowing along the inner circumferential surface of the lateral surface portion 212 of the rotating filter 210 in the first area a1 and the second area a2. Thus, the flow of the washing liquid with foreign substances, flowing along the inner circumferential surface of the lateral surface portion 212 of the rotating filter 210 in the first area a1, may be maintained stably. With the simple configuration, the filter may be cleaned automatically and readily without incurring large costs.

In the embodiments, a flow partition 260 including a first side portion 262*a* facing the first area a1 and a second side portion 262*b* facing the second area a2 may be disposed between the first area a1 and the second area a2. Accordingly, since the washing liquids with foreign substances, branched into two and flowing along different inner circumferential surfaces of the lateral surface portion 212, flow stably in different directions, foreign substances s adhered to the lateral surface portion 212 may separate from the lateral surface portion 212 more readily, and generation of an eddy may be suppressed, thereby reducing flow resistance. With the simple configuration, the filter may be cleaned automatically and effectively without incurring large costs.

In the embodiments, the second area a2 may be greater than the first area a1 depending on a position or a shape of the flow partition 260. Accordingly, the first area a1 may become narrow, and generation of an eddy in the first area a1 may be suppressed, thereby preventing foreign substances s from being collected in the first area. Thus, an increase in flow resistance caused by tangled-up and scaled-up foreign substances s inserted in the space between the rotating filter 210 and the flow partition 260 facing the second outlet 234 may be prevented. Further, the second area a2 may have a space for collecting foreign substances s. Since the second area a2 may become wide and an eddy may be generated in the second area a2, foreign substances s may be readily collected in the second area a2. With the simple configuration, the filter may be cleaned automatically and effectively without incurring large costs.

In the embodiments, the first side portion 262*a* may protrude convexly. Accordingly, the first area a1 may become narrow, and generation of an eddy in the first area a1 may be suppressed, thereby preventing foreign substances s from being collected in the first area. Thus, an increase in flow resistance caused by tangled-up and scaled-up foreign substances s inserted in the space between the rotating filter 210 and the flow partition 260 facing the second outlet 234 may be prevented. Further, the second area a2 may have a space for collecting foreign substances s. Since the second area a2 may become wide and an eddy may be generated in the second area a2, foreign substances s may be readily collected in the second area a2. With the simple configuration, the filter may be cleaned automatically and effectively without incurring large costs.

In the embodiments, the first side portion 262*a* may be spaced a predetermined distance apart from the inner circumferential surface of the lateral surface portion 212 of the rotating filter 210 and formed inside the rotating filter 210 along the inner circumferential surface of the lateral surface portion 212 of the rotating filter 210. Accordingly, the washing liquid with foreign substances, flowing along the inner circumferential surface of the lateral surface portion 212 of the rotating filter 210 in the first area a1, may keep flowing stably, thereby reducing flow resistance. Additionally, the first area a1 may become narrow, and generation of an eddy in the first area a1 may be suppressed, thereby preventing foreign substances s from being collected in the first area. With the simple configuration, the filter may be cleaned automatically and readily without incurring large costs.

In the embodiments, the second side portion 262*b* may include a section in which a distance from the lateral surface portion 212 of the rotating filter 210, surrounding the second area a2, gradually increases and then decreases further toward the first outlet 224 or the second outlet 234. Accordingly, the second area a2 may have a space for collecting foreign substances s. Further, the second area a2 may become greater than the first area a1. With the simple configuration, the filter may be cleaned automatically, effectively and readily without incurring large costs.

In the embodiments, the second side portion 262*b* may include a flat surface shape in parallel with a virtual partition P. Accordingly, the second area a2 may become greater than the first area a1. With the simple configuration, the filter may be cleaned automatically, effectively and readily without incurring large costs.

In the embodiments, a portion of the flow partition 260, facing the second outlet 234, may be formed to cover the second outlet 234 entirely. Accordingly, the foreign substances s collected in the second area a2 may be prevented from keeping moving to the first area a1 or the foreign substances s collected in the first area a1 may be prevented from keeping moving to the second area a2 such that the foreign substances s are prevented from being adhered to the rotating filter 210 facing the second outlet 234, thereby reducing flow resistance effectively. With the simple configuration, the filter may be cleaned automatically, effectively and readily without incurring large costs.

In the embodiments, the body 226 and the first outlet 224 of the inlet guide 220 may be at least partially disposed inside the rotating filter 210. The body 226 may be elongated toward the second outlet 234, and accordingly, a vacant space in the body 226 connecting a first inlet 222 and the first outlet 224 may expand toward the second outlet 234. The body 226 may correspond to the flow partition 260. Thus, a flow cross-sectional area in which a washing liquid including foreign substances can flow may increase, and flow resistance may decrease. With the simple configuration, the filter may be cleaned automatically, effectively and readily without incurring large costs. Additionally, since the inlet guide 220 may be substituted for the flow partition 260 and may separate the first area a1 from the second area a2, an automatic cleaning device may be manufactured readily and simply without incurring large costs using a minimum number of parts.

In the embodiments, the first inlet 222 of the inlet guide 220 may be formed in an upper portion of the body 226 to face an upward direction, and a filter 250 may be disposed on top of the first inlet 222. The filter 250 may include a plurality of second holes 252 having a size greater than a size of a first hole 213 formed in the rotating filter 210. Accordingly, the filter 250 may filter foreign substances before a washing liquid including foreign substances flows into the rotating filter 210. With the simple configuration, the rotating filter 210 may be cleaned automatically, effectively and readily without incurring large costs.

In the embodiments, a washing nozzle 242 configured to spray a washing liquid toward the rotating filter 210 may be disposed on the housing wall 232. Accordingly, since the washing nozzle 242 sprays a washing liquid toward the outer circumferential surface of the lateral surface portion 212 from the outside of the rotating filter 210, the foreign substances adhered to the inner circumferential surface of the lateral surface portion 212 may be readily taken away toward the inside of the lateral surface portion 212. With the simple configuration, the filter may be cleaned automatically and effectively without incurring large costs.

In the embodiments, the washing nozzle 242 may be disposed to face the first outlet 224, and may spray a washing liquid in a direction opposite to the predetermined direction faced by the first outlet 224. Accordingly, even though the washing nozzle 242 sprays a washing liquid, the washing liquid may readily separate foreign substances s from the lateral surface portion 212 without interfering with flows of washing liquids flowing along the inner circumferential surface of the lateral surface portion 212 of the rotating filter 210 in different directions in the first area a1 and the second area a2 and including foreign substances. With the simple configuration, the filter may be cleaned automatically and effectively without incurring large costs.

In the embodiments, the washing nozzle 242 may be long in the up-down direction and formed toward the outer circumferential surface of the lateral surface portion 212. Accordingly, although the washing nozzle 242 sprays a washing liquid, the washing liquid with foreign substances, flowing along the inner circumferential surface of the lateral surface portion 212 in the first area a1 and the second area a2, may keep flowing stably in the up-down direction, foreign substances s adhered to the lateral surface portion 212 may separate from the lateral surface portion 212 more readily, and generation of an eddy may be suppressed, thereby reducing flow resistance. With the simple configuration, the filter may be cleaned automatically and effectively without incurring large costs.

In the embodiments, the filter housing 230 may correspond to the sump 100. Accordingly, a dishwasher equipped with the automatic cleaning filter 200 may have a simple structure, thereby reducing costs, scaling down the dishwasher and making the dishwasher more lightweight.

Specific effects are described along with the above-described effects in the section of Detailed Description.

BRIEF DESCRIPTION OF THE DRAWINGS

The accompanying drawings constitute a part of the specification, illustrate one or more embodiments in the disclosure, and together with the specification, explain the disclosure, wherein.

DETAILED DESCRIPTION OF EXEMPLARY IMPLEMENTATIONS

Figure 1:
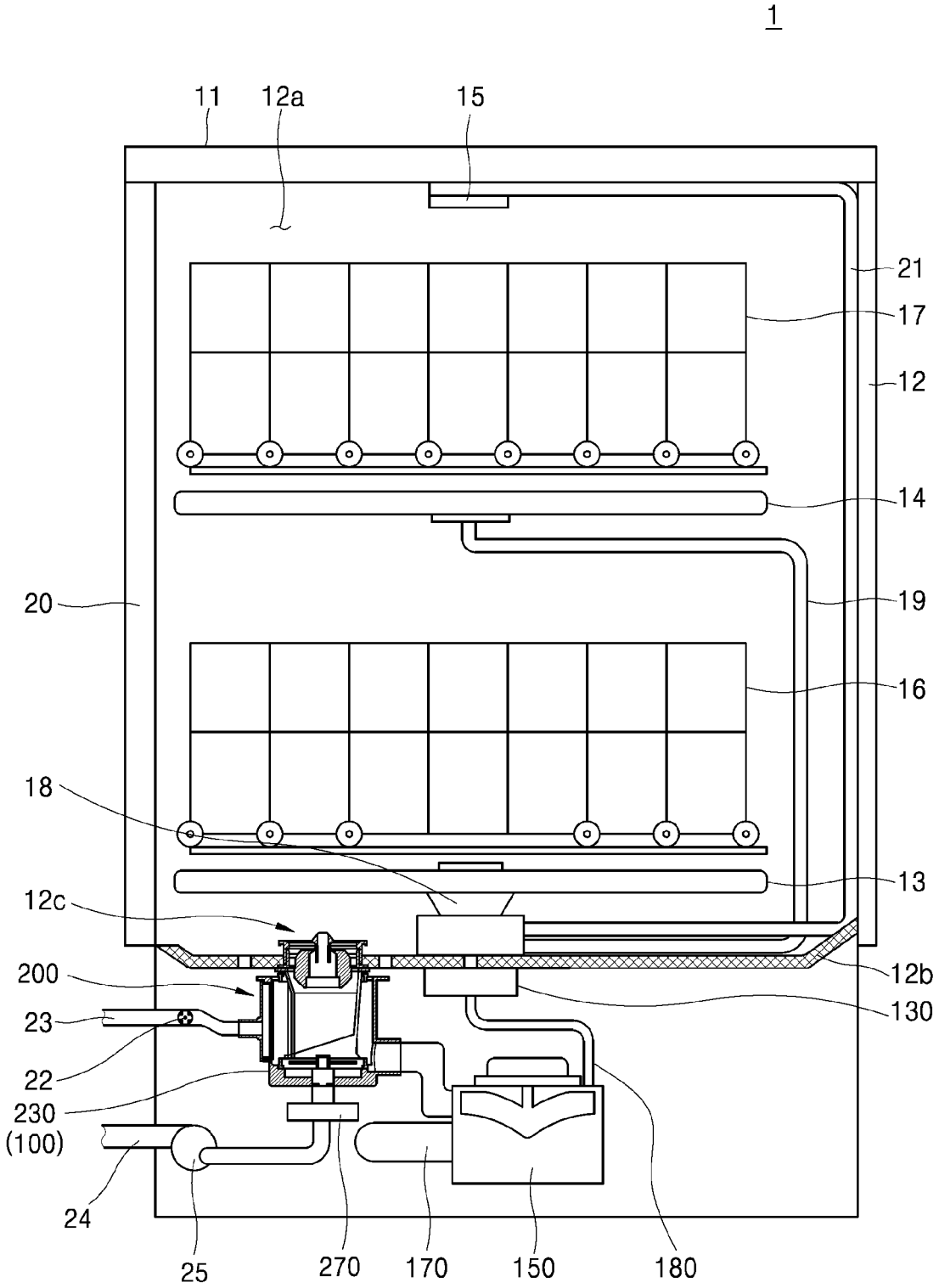
FIG. 1 is a schematic view showing a shape of a dishwasher equipped with an automatic cleaning filter in one embodiment.
Figure 2:
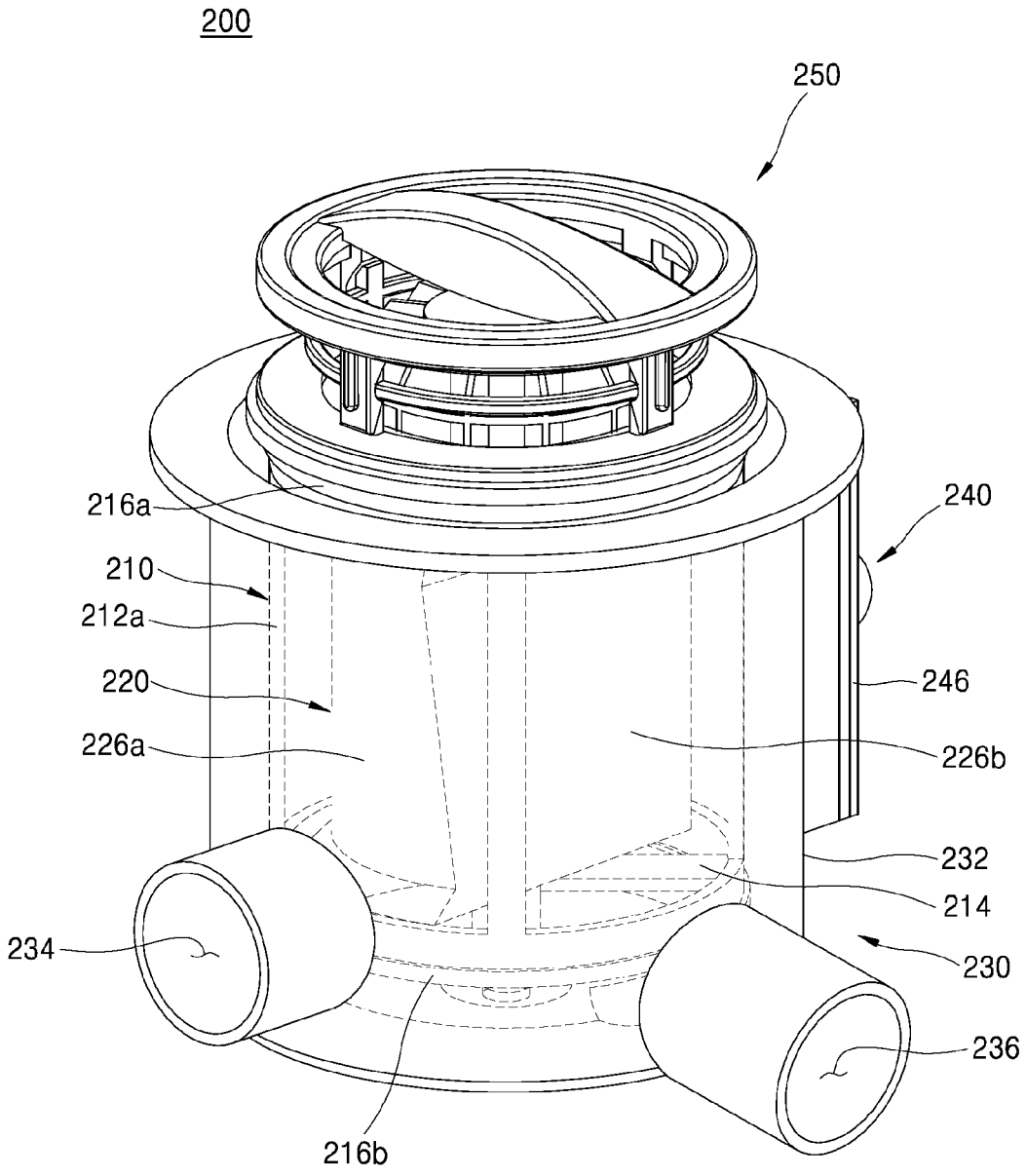
FIGS. 2 to 5 are perspective views showing an automatic cleaning filter in one embodiment, seen from different angles.
Figure 3:
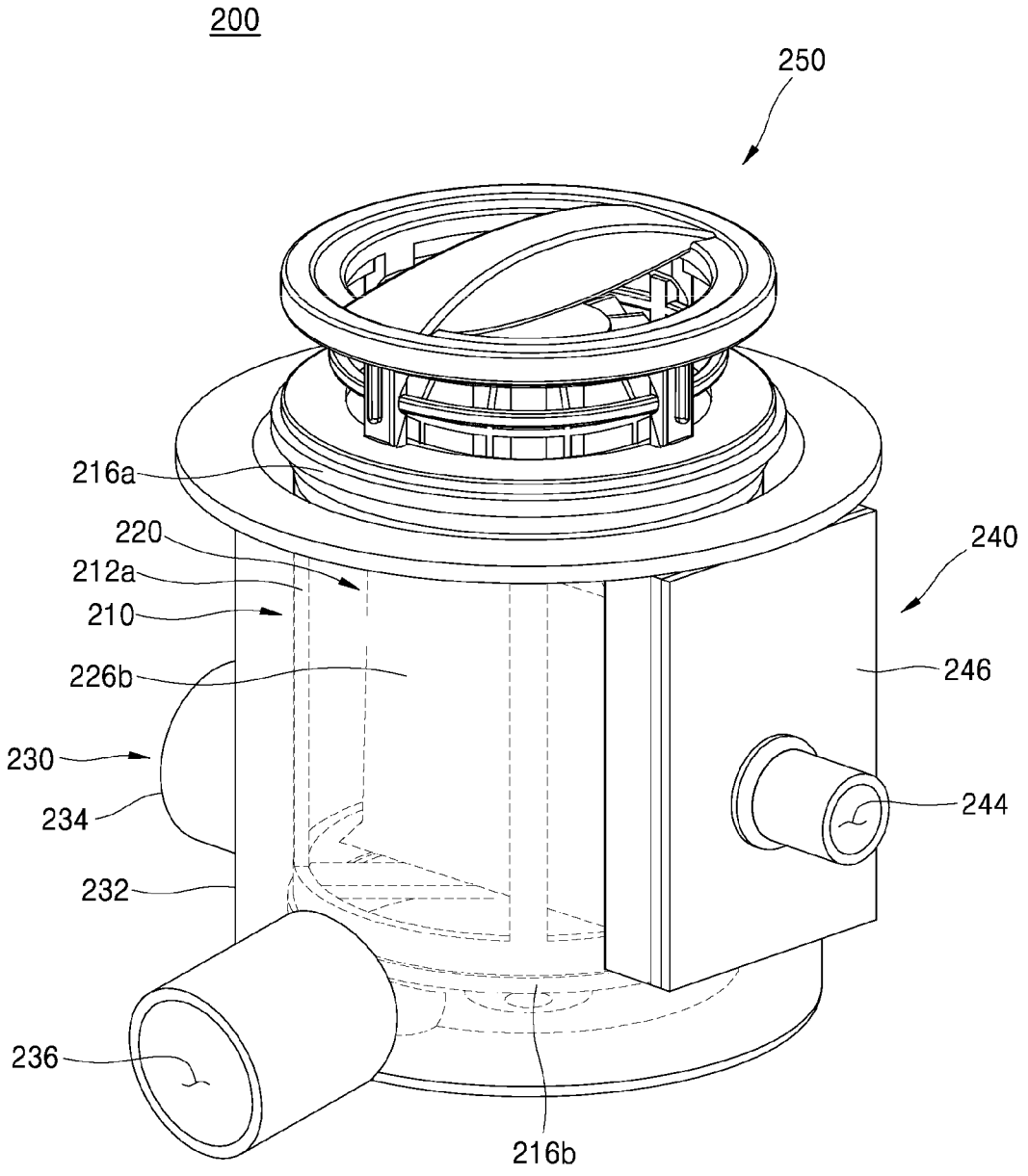
Figure 4:
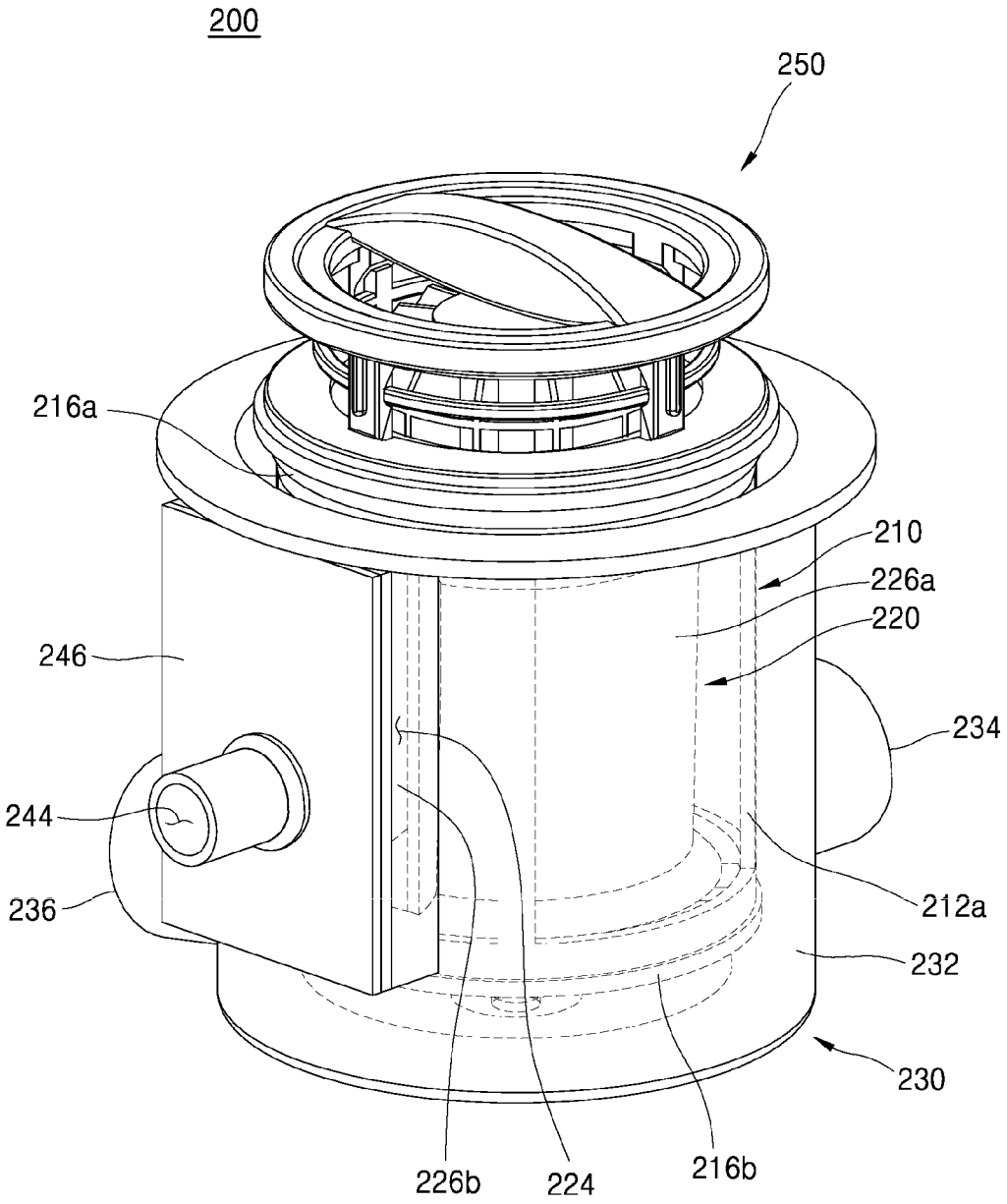
Figure 5:
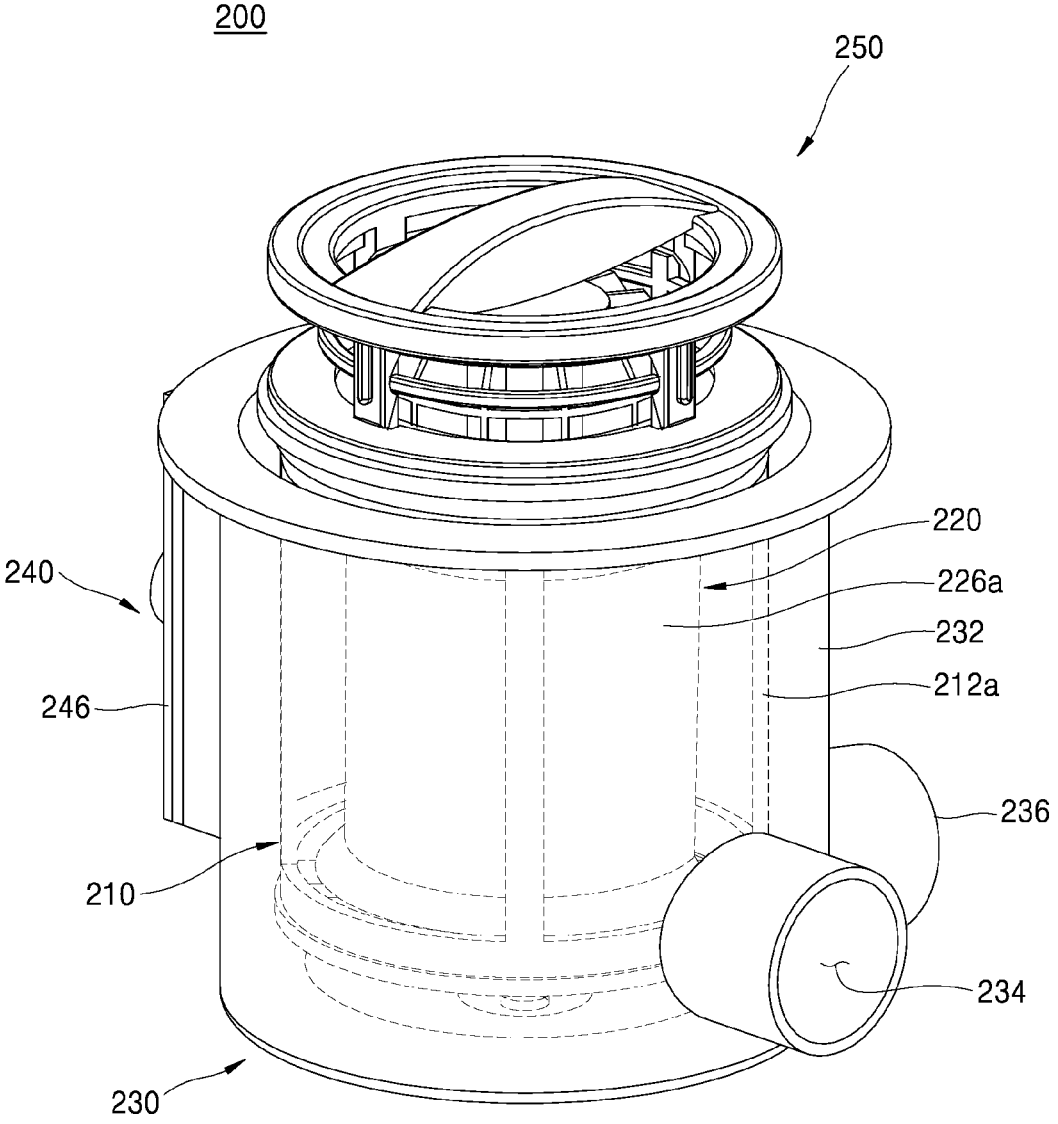
Figure 6:
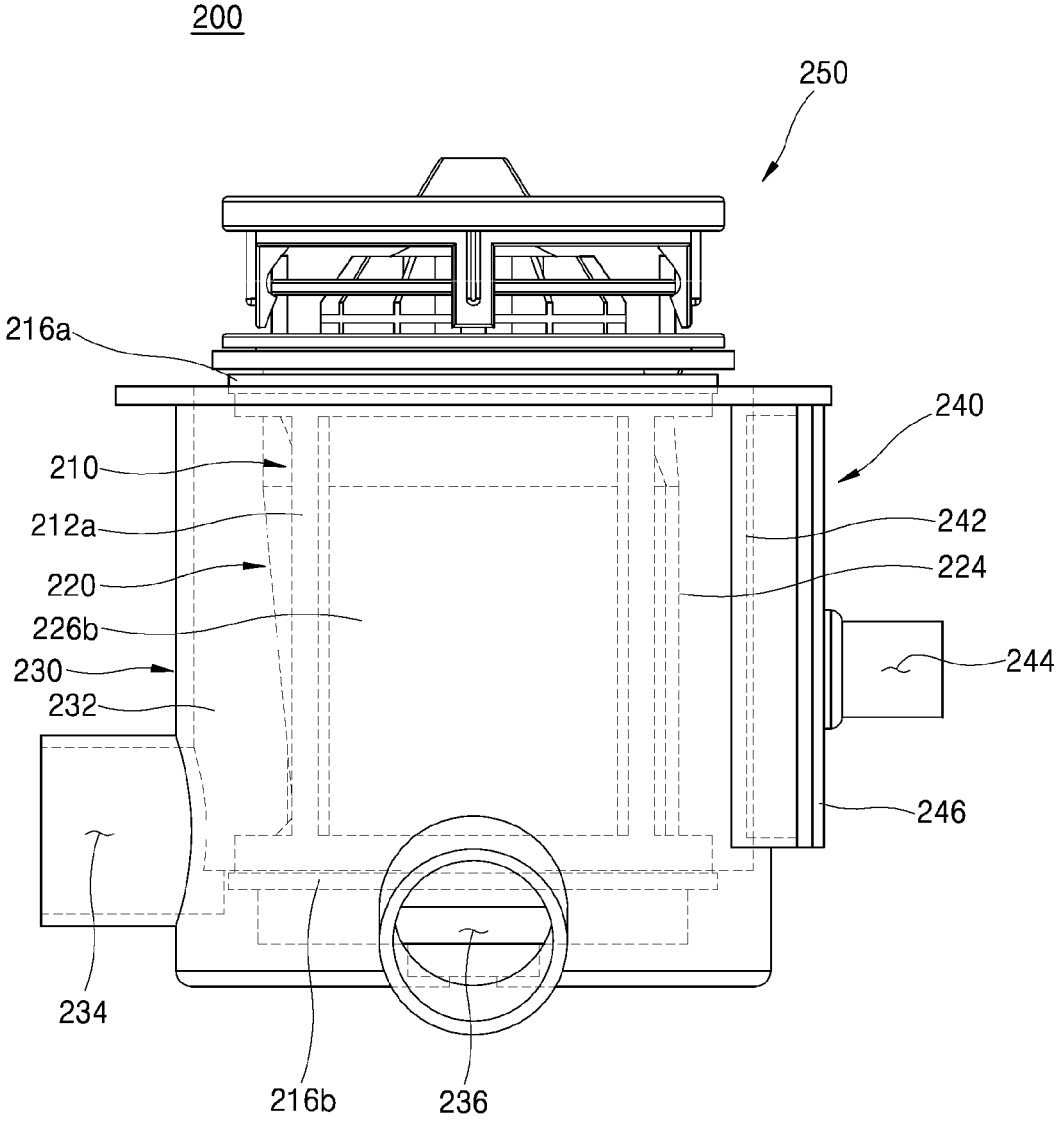
FIGS. 6 to 11 are a front view, a left side view, a right side view, a rear view, a plan view and a bottom view of the automatic cleaning filter in FIGS. 2 to 5.
Figure 7:
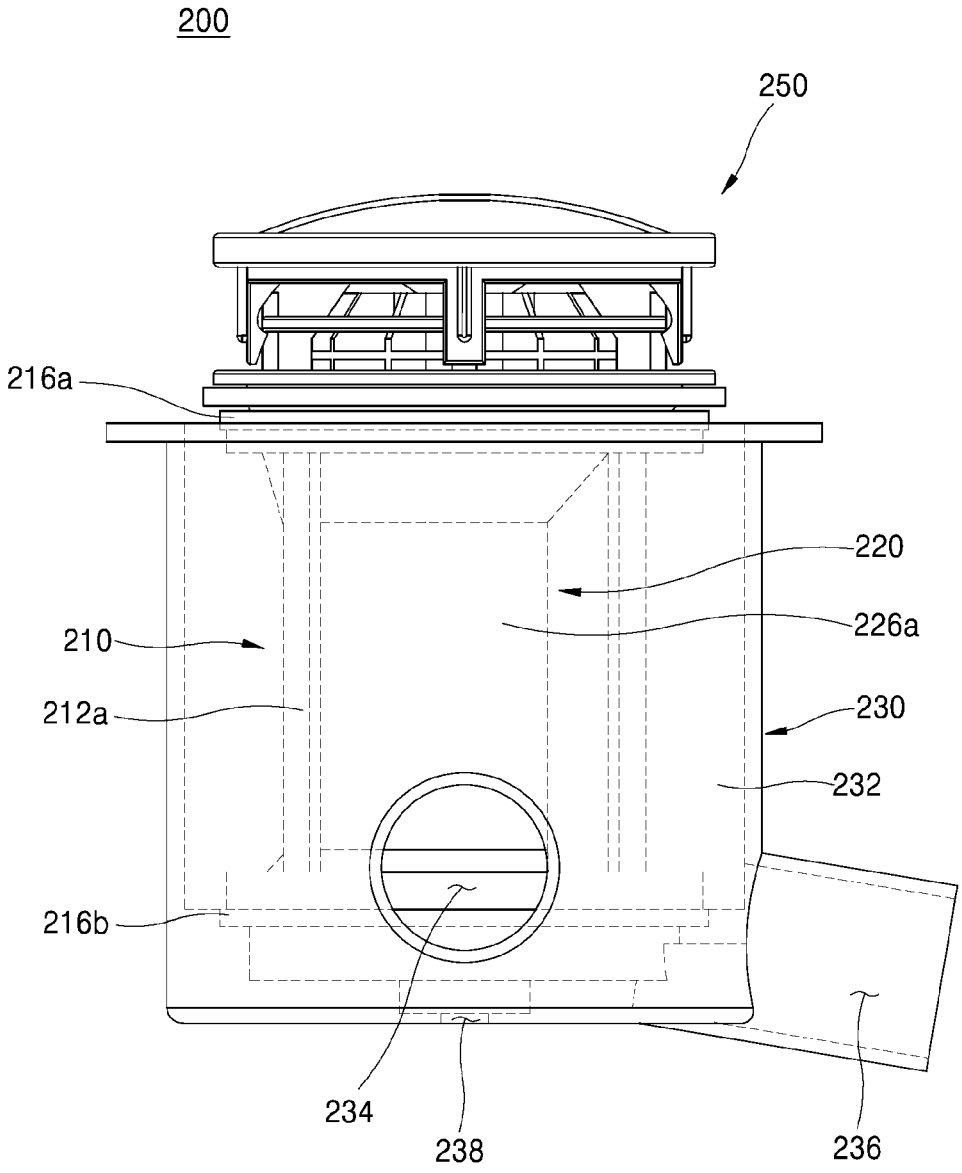
Figure 8:
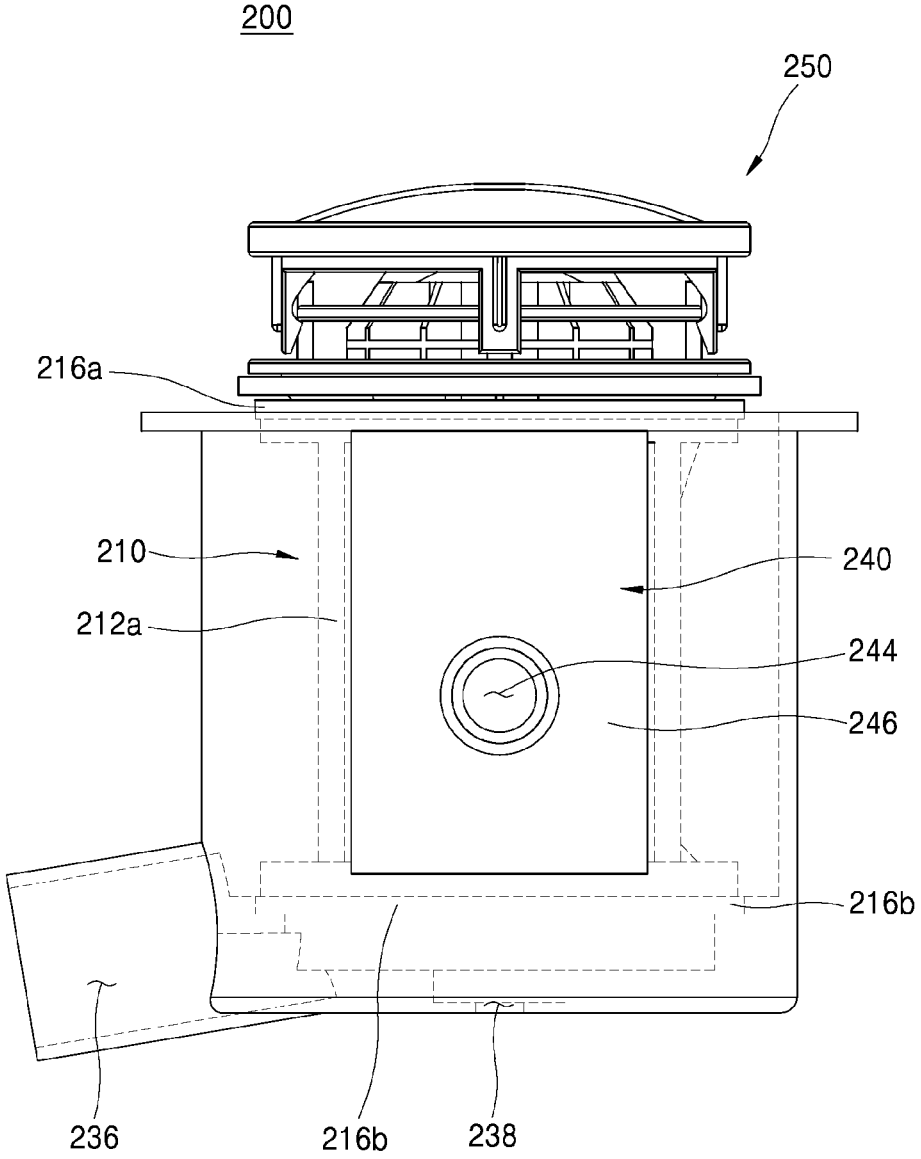
Figure 9:
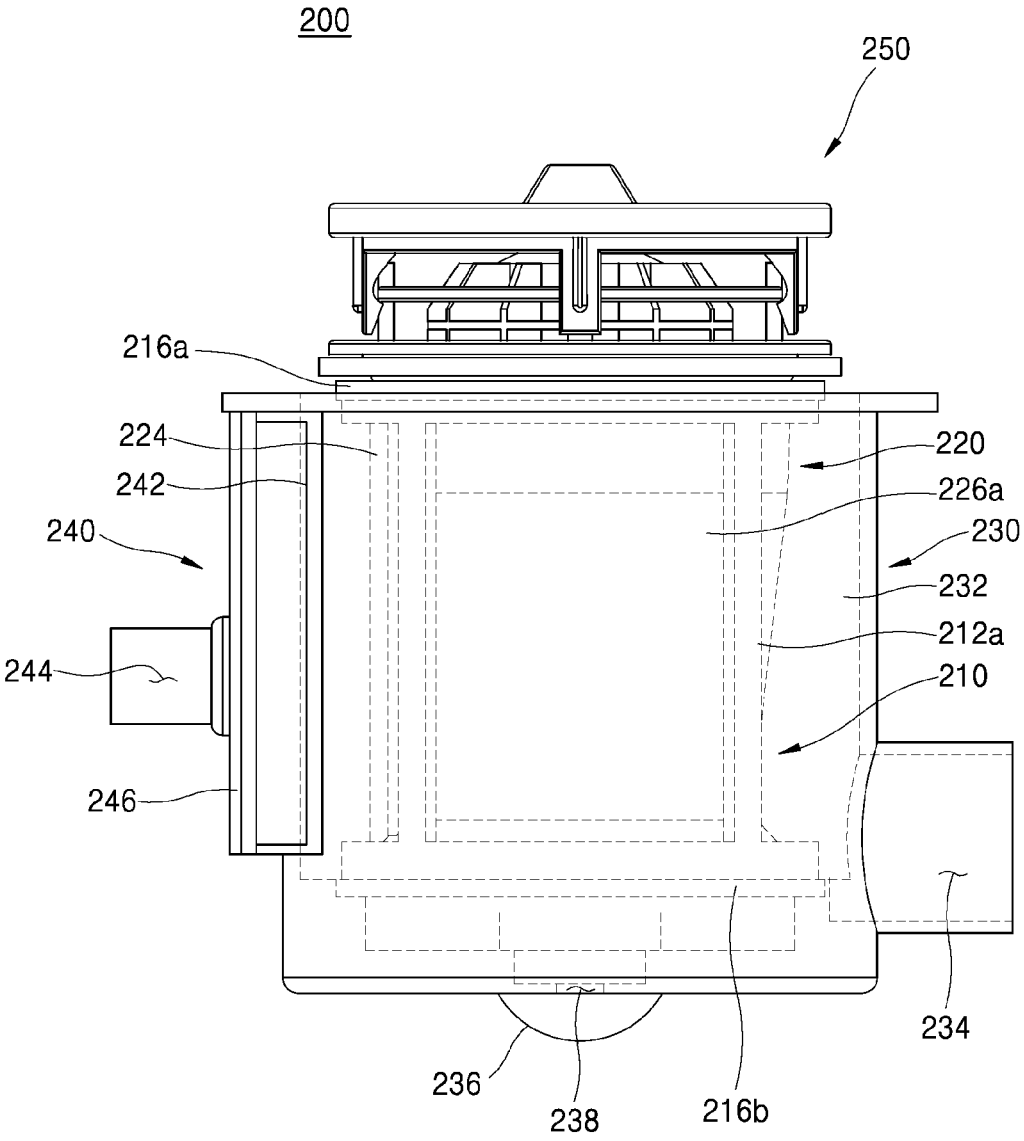
Figure 10:
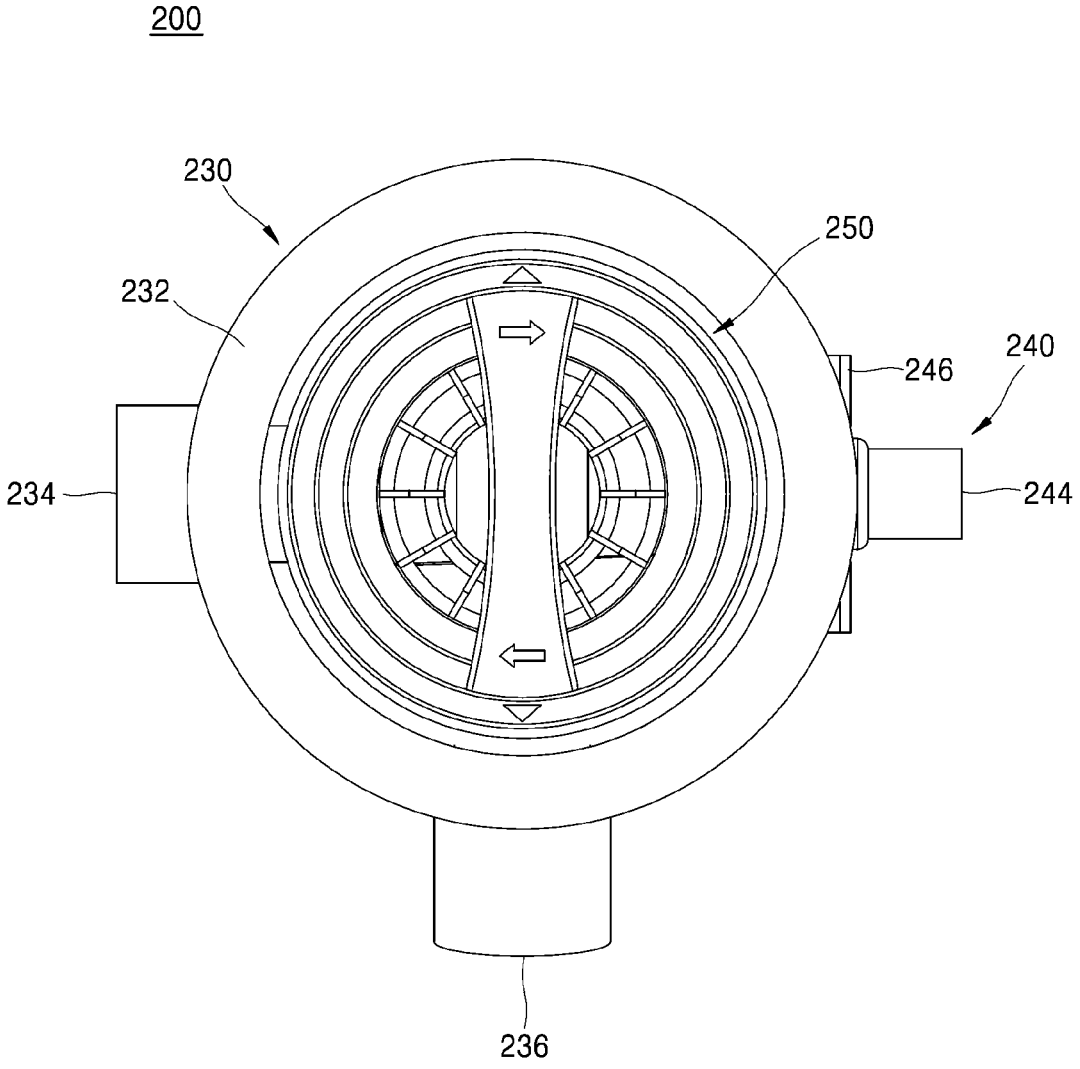
Figure 11:
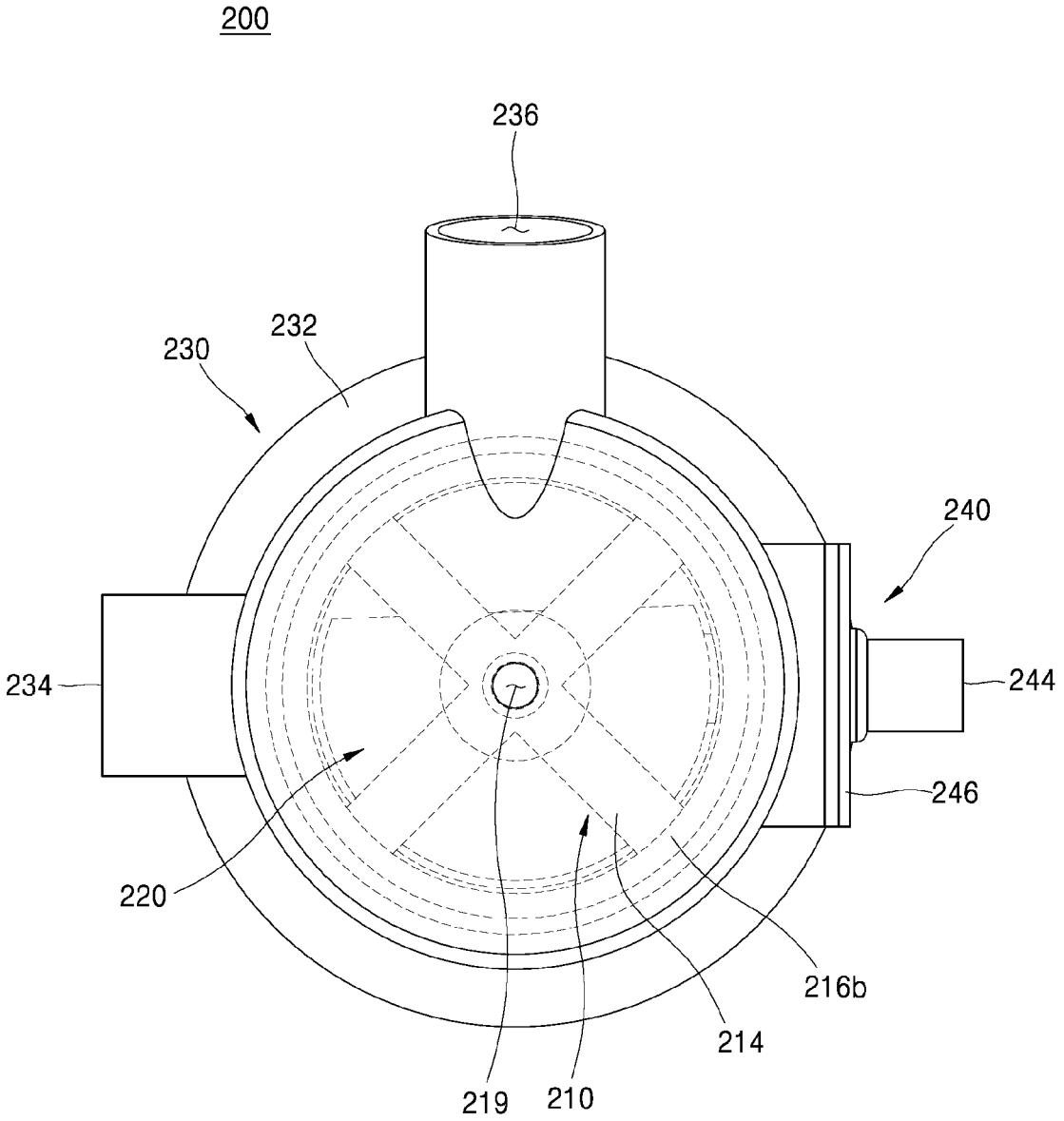
Figure 12:
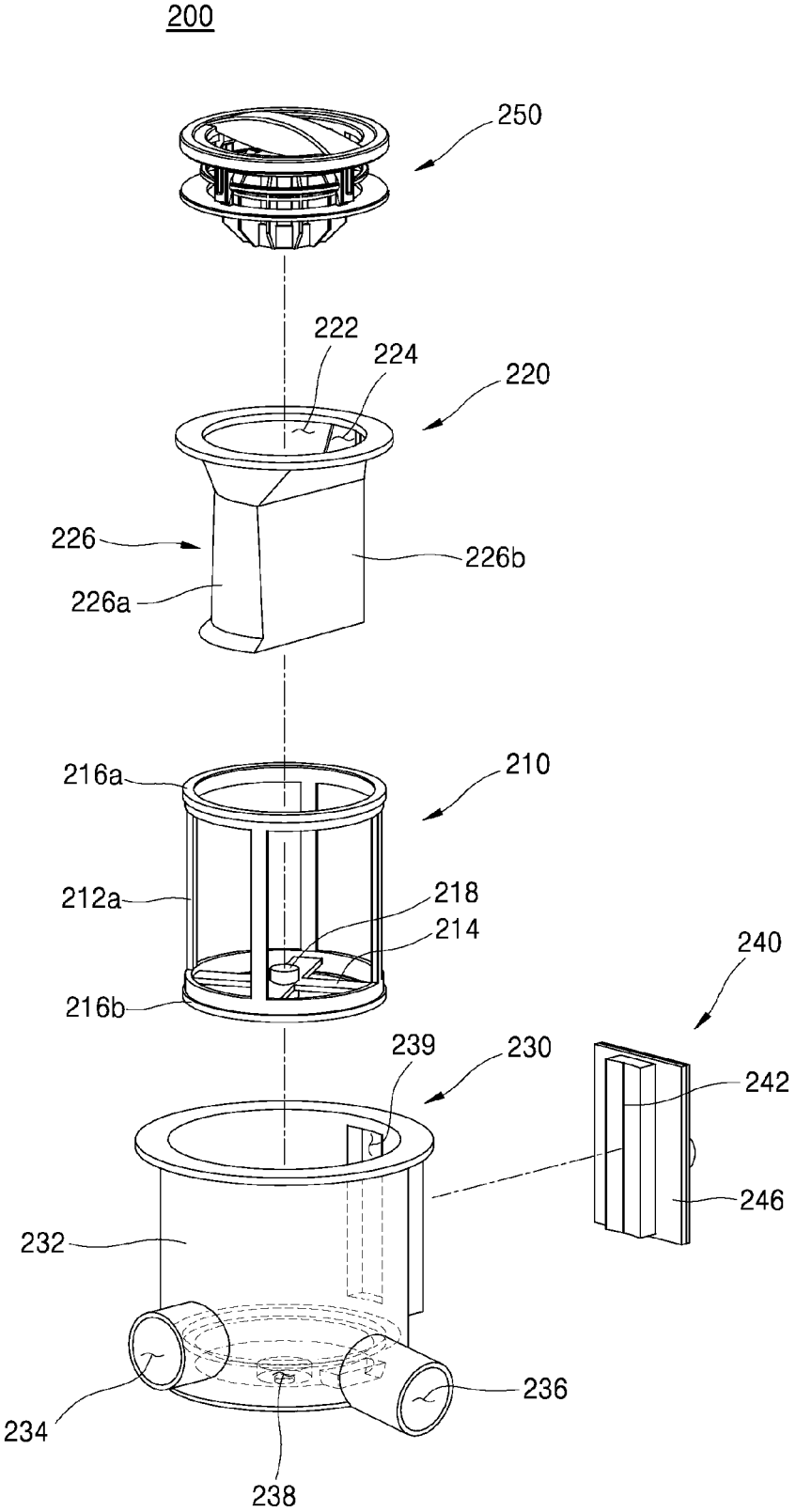
FIGS. 12 to 15 are exploded perspective views respectively showing the state of FIGS. 2 to 5.
Figure 13:
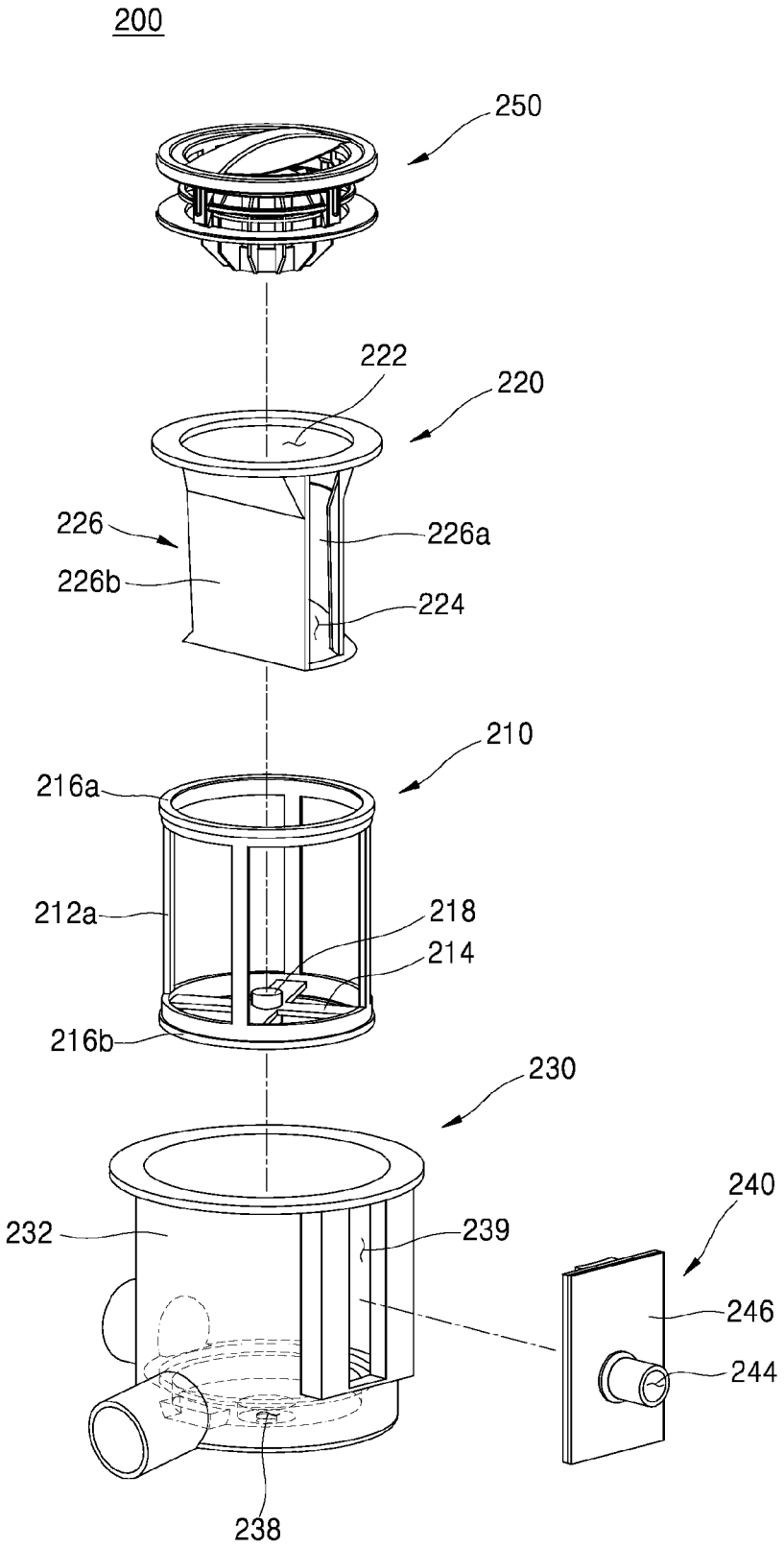
Figure 14:
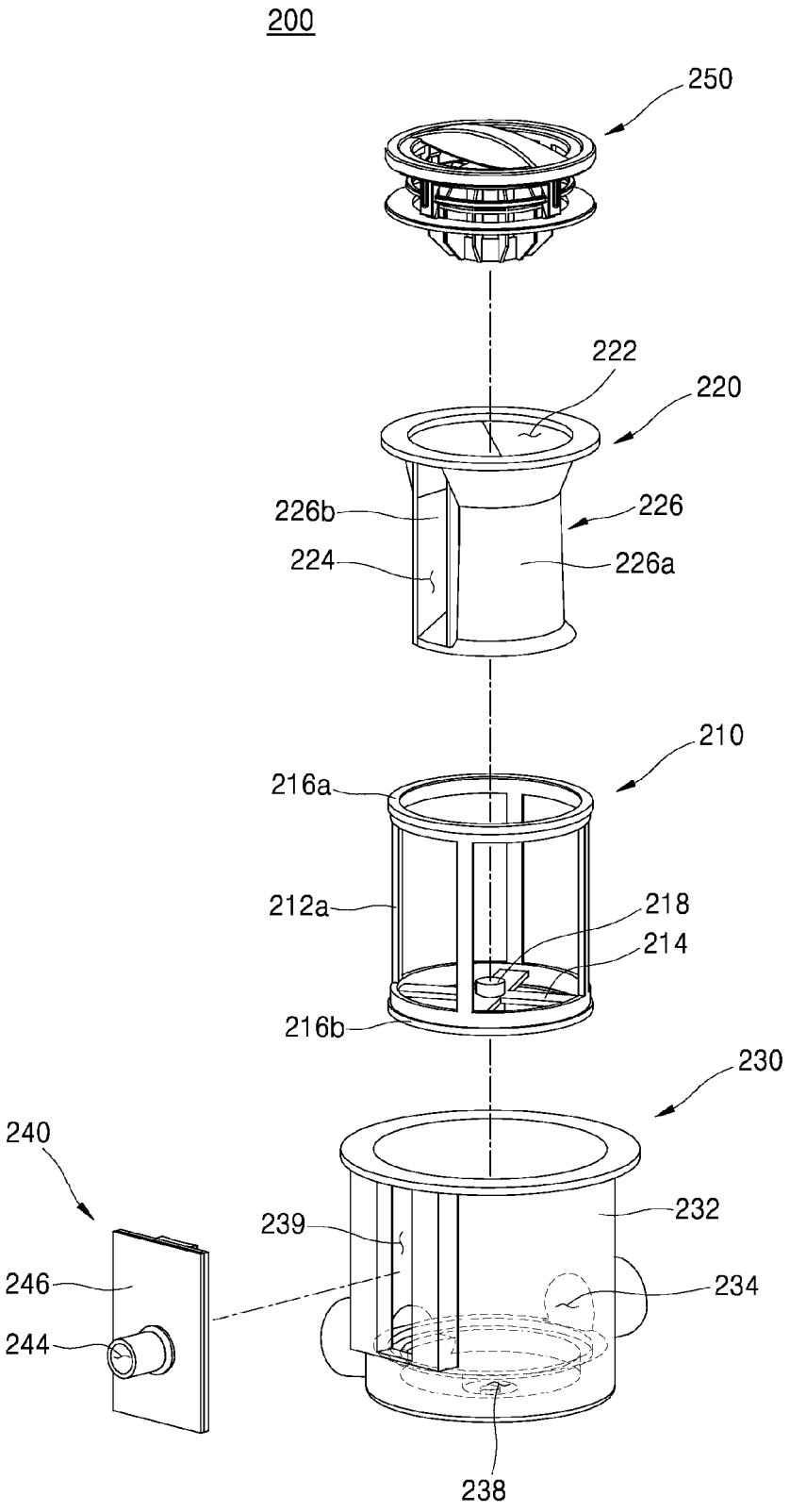
Figure 15:
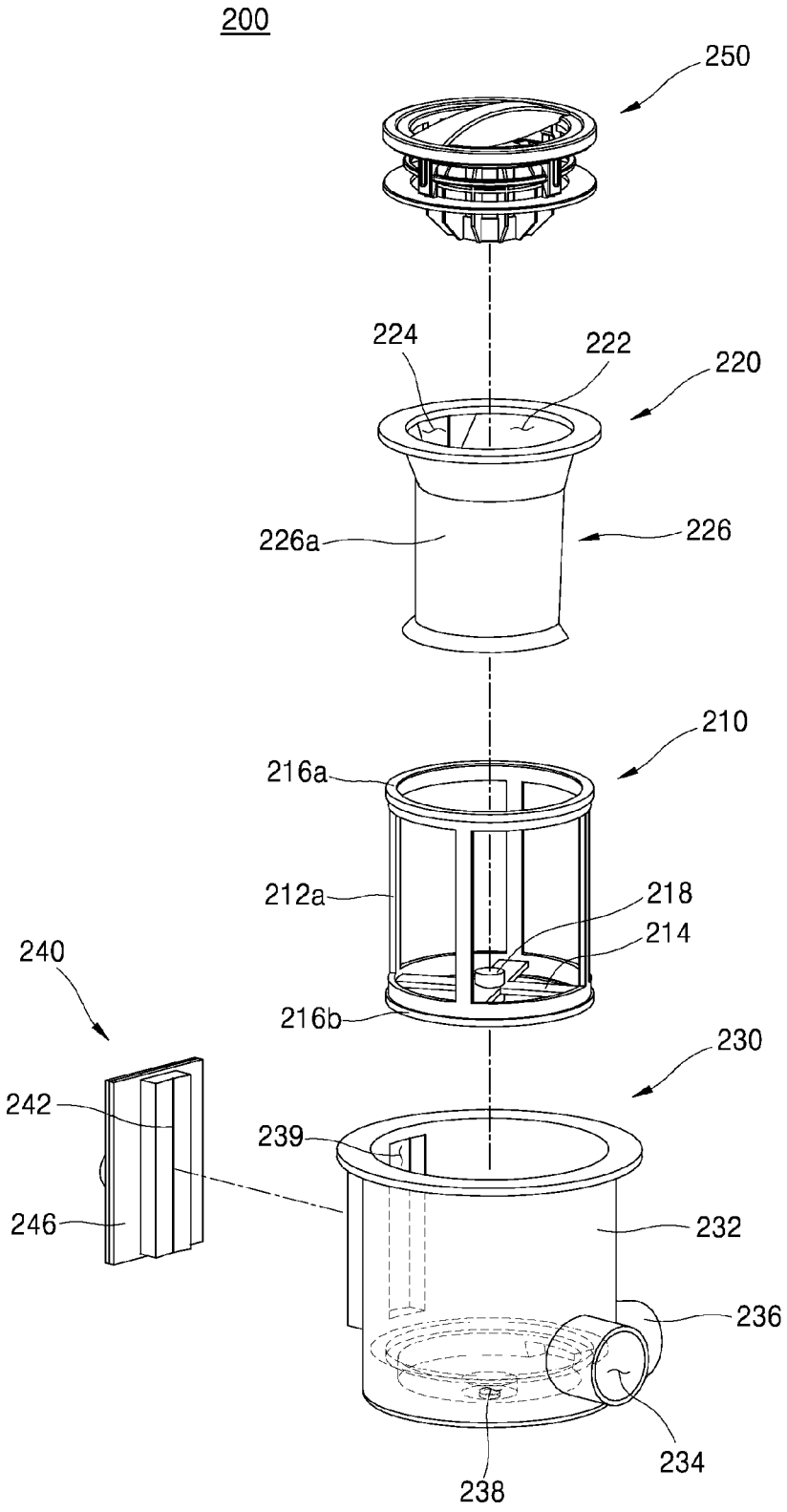

The above-described aspects, features and advantages are specifically described hereunder with reference to the accompanying drawings such that one having ordinary skill in the art to which the present disclosure pertains can easily implement the technical spirit of the disclosure. In the disclosure, detailed description of known technologies in relation to the disclosure is omitted if it is deemed to make the gist of the disclosure unnecessarily vague. Below, preferred embodiments according to the disclosure are specifically described with reference to the accompanying drawings. In the drawings, identical reference numerals can denote identical or similar components.

Embodiments can be implemented in various different forms, and should not be construed as being limited only to the embodiments set forth herein. Rather, these embodiments are provided as examples so that the present disclosure will be thorough and complete and will fully convey the subject matter of the present disclosure to one having ordinary skill in the art to which the disclosure pertains. Thus, embodiments are not limited to the embodiments set forth herein, a component in any one embodiment can be replaced with or added to a component in another embodiment, and all the modifications, equivalents or replacements should be included in the technical spirit and scope of the disclosure.

Accompanying drawings are provided for better understanding of the embodiments in the disclosure and are not intended to limit the technical spirit of the disclosure. It is to be understood that all the modifications, equivalents or replacements are included in the technical spirit and scope of the disclosure. In the drawings, the thicknesses of lines or the sizes of the components can be exaggerated for the sake of convenience and clarity in description but not intended to limit the protection scope of the disclosure.

Terms herein are used only to describe a specific implementation or embodiment but not intended to limit the disclosure. The singular forms "a", "an" and "the" are intended to include the plural forms as well, unless explicitly indicated otherwise. It will be further understood that the terms "comprise", "have" and the like used in the disclosure define the presence of features, numbers, steps, operations, components, parts or combinations thereof set forth herein. That is, the terms "comprise", "have" and the like throughout the disclosure should not be interpreted as excluding the possibility of the presence or addition of one or more different features, or numbers, steps, operations, components, parts or combinations thereof. Further, the terms "comprise", "have" and the like throughout the disclosure should not be interpreted as necessarily including the features, numbers, steps, operations, components, parts or combinations thereof set forth herein.

The terms "first", "second" and the like are used herein only to distinguish one component from another component. Thus, the components should not be limited by the terms. Certainly, a first component can be a second component unless stated to the contrary.

When one component is described as being "connected", "coupled", or "connected" to another component, one component can be directly connected, coupled or connected to another component. However, it is also to be understood that an additional component can be "interposed" between the two components, or the two components can be "connected", "coupled", or "connected" through an additional component.

When one component is described as being "in an upper portion (or a lower portion)" of another component, or "on (or under)" another component, one component can be placed on the upper surface (or under the lower surface) of another component, and an additional component can be interposed between one component and another component.

Unless otherwise defined, all the terms including technical terms or scientific terms, used herein, have the same meaning as commonly understood by one skilled in the art to which the disclosure pertains. It is to be understood that terms such as those defined in commonly used dictionaries should be interpreted as having a meaning that is consistent with their meaning in the context of the relevant art and should not be interpreted in an idealized or overly formal sense unless explicitly so defined herein.

An automatic cleaning filter in several embodiments and a dishwasher equipped with the same are described hereunder.

FIG. 1 is a schematic view showing a shape of a dishwasher equipped with an automatic cleaning filter in one embodiment. The automatic cleaning filter 200 in the embodiment of FIG. 1 may be used for various types of products in addition to the dishwasher 1.

Referring to FIG. 1, the dishwasher 1 equipped with an automatic cleaning filter in one embodiment may include a case 11, a tub 12, a door 20, a sump 100, a plurality of spray arms 13, 14, 15, a washing pump 150, a diverting valve 130, a water supply valve 22, a drainage pump 25, and an automatic cleaning filter 200. Each of the components is described hereunder.

The case 11 may form an exterior of the dishwasher 1.

The tub 12 may be disposed in the case 11, and may have a cuboid shape a front surface of which is open. However, the shape of the tub 12 may not be limited. The tub 12 may have different shapes.

The tub 12 may be provided therein with a washing space 12*a* that accommodates an object to be washed. A communication hole 12*c* through which a washing liquid flows into the sump 100 may be formed at a bottom 12*b* of the tub 12. The tub 12 may be provided with the door 20 at a front thereof, and the door 20 may open and close the washing space 12*a*.

A plurality of racks 16, 17 on which an object to be washed such as a cooking vessel and the like is placed may be disposed in the washing space 12*a*. The plurality of racks 16, 17 may include a lower rack 16 disposed in a lower portion of the washing space 12*a*, and an upper rack 17 disposed in an upper portion of the washing space 12*a*. The lower rack 16 and the upper rack 17 may be spaced from each other in an up-down direction, and may be slid and withdrawn to the front of the tub.

The plurality of spray arms 13, 14, 15 may be spaced from one another in the up-down direction. The plurality of spray arms 13, 14, 15 may include a lower spray arm 13, an upper spray arm 14, and a top spray arm 15. The lower spray arm 13 may be disposed at a lowermost end of the washing space 12*a*, and may spray a washing liquid toward the lower rack 16 from a lower side to an upper side. The upper spray arm 14 may be disposed on an upper side of the lower spray arm 13, and may spray a washing liquid toward the upper rack 17 from the lower side to the upper side. The top spray arm 15 may be disposed at an uppermost end of the washing space 12*a* and may spray a washing liquid from the upper side to the lower side.

The plurality of spray arms 13, 14, 15 may receive a washing liquid from the washing pump 150 through a plurality of spray arm connection channels 18, 19, 21. The plurality of spray arm connection channels 18, 19, 21 may include a lower spray arm connection channel 18, an upper spray arm connection channel 19, and a top spray arm connection channel 21. The lower spray arm connection channel 18 may connect to the lower spray arm 13, the upper spray arm connection channel 19 may connect to the upper spray arm 14, and the top spray arm connection channel 21 may connect to the top spray arm 15.

The sump 100 may be disposed on a lower side of the bottom 12*b* of the tub 12 and may collect and store a washing liquid. Specifically, the sump 100 may connect to a water supply channel 23, and may receive a clean washing liquid including no foreign substances through the water supply channel 23 and may store the same.

The sump 100 may be provided with the automatic cleaning filter 200, and may receive a washing liquid from which foreign substances are filtered through the automatic cleaning filter 200 and may store the same. The sump 100 may correspond to a filter housing 230 of the automatic cleaning filter 200 as illustrated in FIG. 1. Description in relation to this is provided below.

The water supply valve 22 may regulate a washing liquid supplied from an external water source though the water supply channel 23. When the water supply valve 22 is opened, the washing liquid supplied from the external water source may flow into the sump 100 or the filter housing 230 of the automatic cleaning filter 200 through the water supply channel 23.

The water supply channel 23 may connect to the sump 100 or a water supply portion 240 of the automatic cleaning filter 200.

A drainage channel 24 may connect to the drainage pump 25 and the sump 100 or a discharge opening 236 of the automatic cleaning filter 200.

The drainage pump 25 may connect to the drainage channel 24 and may include a drainage motor (not illustrated).

When the drainage pump 25 operates, the washing liquid or foreign substances stored in the sump 100 or the filter housing 230 of the automatic cleaning filter 200 may be discharged out of the case 11 through the drainage channel 24.

The washing pump 150 may supply the washing liquid stored in the sump 100 or the filter housing 230 of the automatic cleaning filter 200 to the plurality of spray arms 13, 14, 15. The washing pump 150 may repeat supplying the washing liquid stored in the sump 100 or the filter housing 230 of the automatic cleaning filter 200 to the plurality of spray arms 13, 14, 15 to re-circulate the washing liquid.

The diverting valve 130 may selectively connect to the washing pump 150 and at least one of the plurality of spray arms 13, 14, 15.

The automatic cleaning filter 200 may be disposed in the sump 100 and installed in the communication hole 12*c*. The automatic cleaning filter 200 may filter foreign substances from a washing liquid with the foreign substances, moving from the tub 12 to the sump 100. Description in relation to this is provided below.

The filter housing 230 of the automatic cleaning filter 200 may correspond to the sump 100. Accordingly, a dishwasher equipped with the automatic cleaning filter 200 may have a simple structure, thereby reducing costs, scaling down the dishwasher and making the dishwasher more lightweight.

Figure 16:
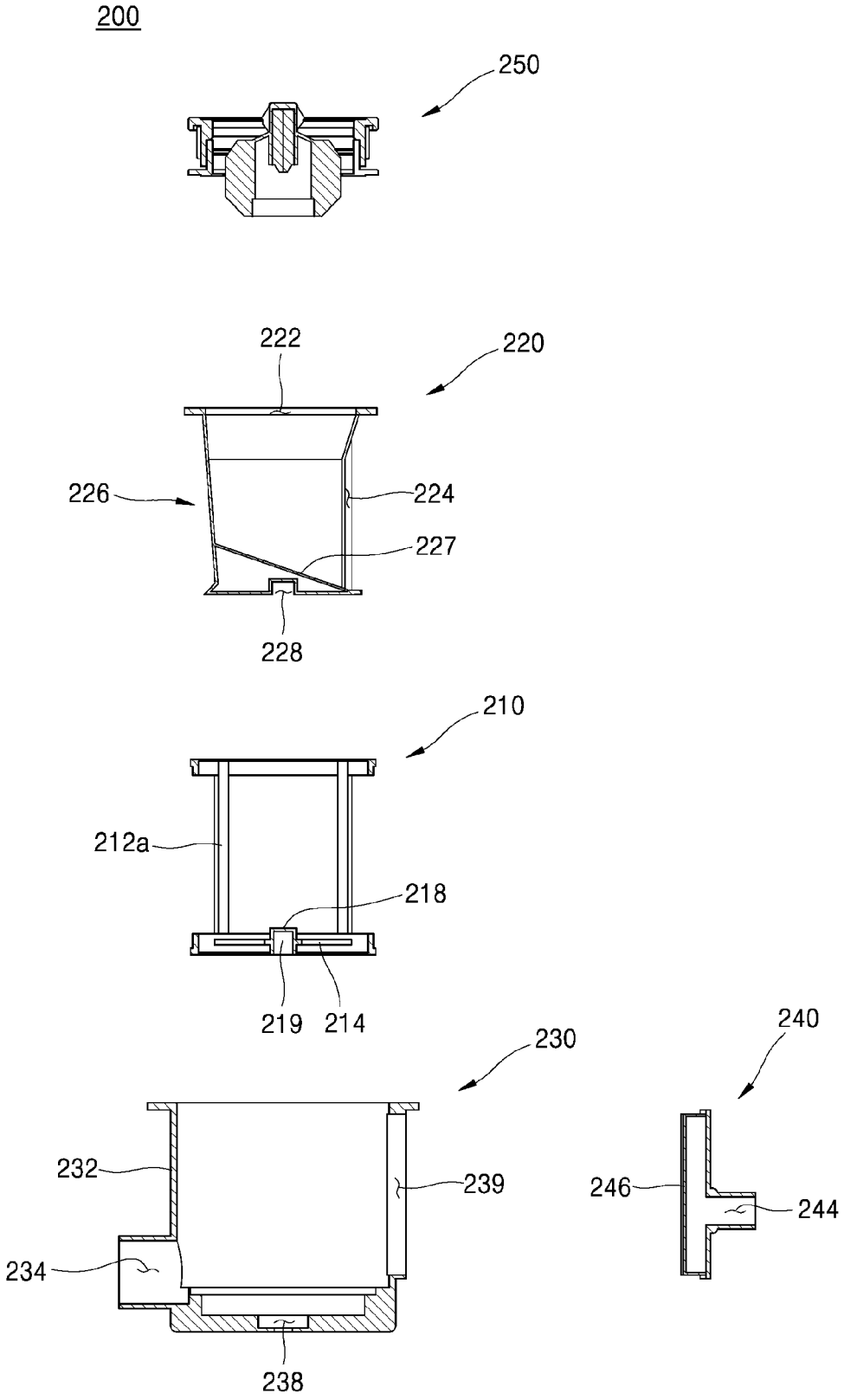
FIG. 16 is an exploded cross-sectional view showing the state of FIG. 6.
Figure 17:
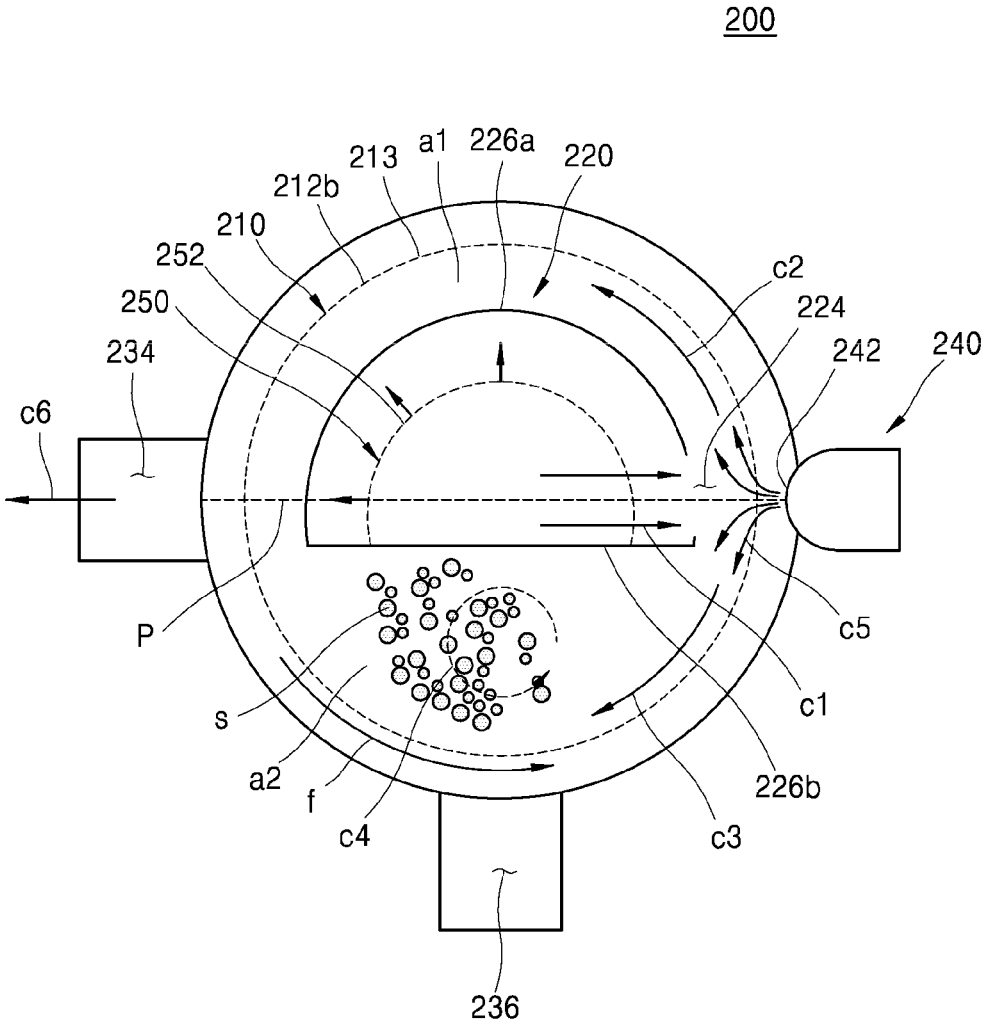
FIGS. 17 and 18 are schematic views showing a state in which the automatic cleaning filter in FIGS. 2 to 16 operates.
Figure 18:
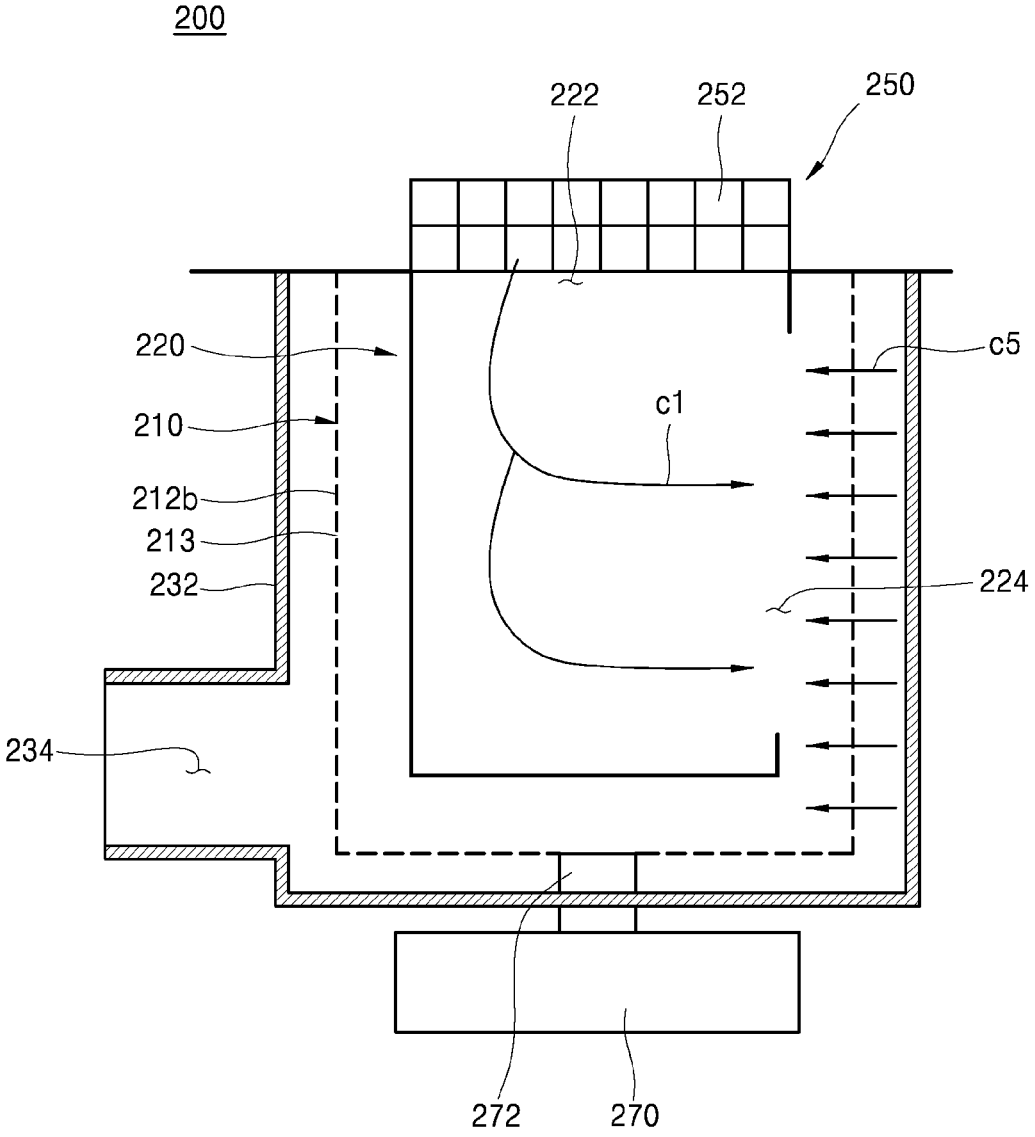

FIGS. 2 to 5 are perspective views showing an automatic cleaning filter in one embodiment, seen from different angles. FIGS. 6 to 11 are a front view, a left side view, a right side view, a rear view, a plan view and a bottom view of the automatic cleaning filter in FIGS. 2 to 5. FIGS. 12 to 15 are exploded perspective views respectively showing the state of FIGS. 2 to 5. FIG. 16 is an exploded cross-sectional view showing the state of FIG. 6. FIGS. 17 and 18 are schematic views showing a state in which the automatic cleaning filter in FIGS. 2 to 16 operates.

Referring to FIGS. 2 to 18, the automatic cleaning filter 200 in one embodiment may include a rotating filter 210, an inlet guide 220, a filter housing 230, a water supply portion 240, a filter 250, and a driver 270 (FIG. 18).

[Rotating Filter]

The rotating filter 210 may include a lateral surface portion 212, a lower end filter frame 214, an upper end filter frame, and a sealing members 216*a*, 216*b*. The rotating filter 210 may have a cylindrical shape which has a hollow space, an upper portion of which is open and a lower portion of which is partially open. However, the shape of the rotating filter 210 may not be limited.

The rotating filter 210 may rotate around a rotation axis A (FIG. 19) that extends in the up-down direction.

The lateral surface portion 212 may include a lateral surface filter frame 212*a* (FIGS. 2 to 16) and a filter sheet 212*b* (FIGS. 17 and 18) and form a lateral surface of the rotating filter 210. Additionally, the lateral surface portion 212 may surround a predetermined vacant space.

The lateral surface filter frame 212*a* may have a cylindrical shape that is hollow in the up-down direction, as illustrated in FIGS. 2 to 16. However, the shape of the lateral surface filter frame 212*a* may not be limited.

A through hole, which passes through the lateral surface filter frame 212*a* in a direction perpendicular to the up-down direction, may be formed on the lateral surface filter frame 212*a*. Through the through hole formed on the lateral surface filter frame 212*a*, the washing liquid in the rotating filter 210 may pass through the filter sheet 212*b* (FIGS. 17 and 18) and flow to a second outlet 234 outside the rotating filter 210.

The lateral surface filter frame 212*a* may be coupled to the lower end filter frame 214 and the upper end filter frame of the rotating filter 210, and may be coupled or contact the filter sheet 212*b* (FIGS. 17 and 18) to support the filter sheet 212*b*.

The filter sheet 212*b*, as illustrated in FIGS. 17 and 18, may be disposed along a lateral surface of the rotating filter 210 in the up-down direction, and may be coupled to or contact the lateral surface filter frame 212*a*.

A plurality of first holes 213 may be formed on the filter sheet 212*b*. The first hole 213 may filter foreign substances from a washing liquid with the foreign substances, introduced into the rotating filter 210.

The lower end filter frame 214 may have a Frisbee shape and a through hole that passes through the lower end filter frame 214 in the up-down direction. However, the shape of the lower end filter frame 214 may not be limited.

Through the through hole formed on the lower end filter frame 214, foreign substances, which are left inside the lateral surface portion 212 without passing through the filter sheet 212*b* (FIGS. 17 and 18) of the lateral surface portion 212, may move to the discharge opening 236.

A central portion of the lower end filter frame 214 may connect to an edge (a peripheral portion) thereof. That is, the lower end filter frame 214 may not have a through hole in the central portion thereof. A first projection 218 protruding upward may be formed on an upper surface of the central portion of the lower end filter frame 214, and a first groove 219 (FIGS. 11 and 16) may be formed on a lower surface of the central portion of the lower end filter frame 214.

The lower end filter frame 214 may connect to the lateral surface filter frame 212*a* and support the lateral surface filter frame 212*a*.

A lower surface of the lower end filter frame 214 may be coupled to or contact a second sealing member 216*b*.

The upper end filter frame may have a Frisbee shape a central portion of which is open in the up-down direction. However, the shape of the upper end filter frame may not be limited.

The inlet guide 220 may be inserted into the rotating filter 210 through the open central portion of the upper end filter frame. However, the inlet guide 220 may be configured in a way different from the way shown in the drawing. That is, the inlet guide 220 may not be inserted into the rotating filter 210.

The upper end filter frame may be coupled to the lateral surface filter frame 212*a* and may be supported by the lateral surface filter frame 212*a*.

An upper surface of the upper end filter frame may be coupled to or contact a first sealing member 216*a*

The sealing member 216 may have a Frisbee shape a central portion of which is open in the up-down direction. However, the shape of the sealing member 216 may not be limited.

The first sealing member 216*a* may be disposed between the upper end filter frame of the rotating filter 210 and the inlet guide 220, and may be coupled to any one of the upper end filter frame and the inlet guide 220 and may contact the rest of the upper end filter frame and the inlet guide 220.

A second sealing member 216*b* may be disposed between the lower end filter frame 214 of the rotating filter 210 and the filter housing 230, and may be coupled to any one of the lower end filter frame 214 and the filter housing 230 and may contact the rest of the lower end filter frame 214 and the filter housing 230.

The first sealing member 216*a* and the second sealing member 216*b* may reduce friction that is generated when the rotating filter 210 rotates, and may prevent foreign substances from escaping out of the rotating filter 210 and from flowing to the second outlet 234.

The first projection 218 (FIGS. 12 to 16) may be inserted into a second groove 228 (FIG. 16) formed on a lower surface of the inlet guide 220. Accordingly, the rotating filter 210 may support the inlet guide 220 while rotating relative to the inlet guide 220.

The first groove 219 (FIGS. 11 and 16) may be coupled to a rotating shaft 272 of the driver 270 as illustrated in FIG. 18. Accordingly, the rotating filter 210 may rotate in one direction around the rotation axis A (FIG. 19) extended in the up-down direction.

[Inlet Guide]

The inlet guide 220 may include a first inlet 222, a first outlet 224, a body 226 and a second groove 228. The inlet guide 220 may be at least partially disposed inside the rotating filter 210 as in the drawing. However, the inlet guide 220 may be configured in a way different from the way shown in the drawing. That is, the inlet guide 220 may be entirely disposed outside the rotating filter 210.

The inlet guide 220 may discharge a washing liquid with foreign substances, introduced through the first inlet 222, to the first outlet 224, and may guide a direction in which the washing liquid including foreign substances is discharged.

The first inlet 222 may be formed at one end of the body 226. For example, the first inlet 222 may be formed at an upper end of the body 226 toward the upward direction. An upper portion of the first inlet 222 may connect to the filter 250. Forming the first inlet 222 toward the upward direction may denote extending the first inlet 222 in the up-down direction.

A washing liquid including foreign substances may flow into the body 226 through the first inlet 222. The foreign substances may have a size less than a size of a second hole 252 formed in the filter 250.

The first outlet 224 may be formed at the other end of the body 226 and may communicate with the first inlet 222. For example, the first outlet 224, as illustrated in the drawing, may be formed at a lateral end of the body 226 inserted into the rotating filter 210. Accordingly, the first outlet 224 may be disposed inside the rotating filter 210. However, the first outlet 224 may be configured in a way different from the way shown in the drawing. That is, the first outlet 224 may be formed at a lower end of the body 226 disposed on top of the rotating filter 210. Accordingly, the first outlet 224 may be disposed outside the rotating filter 210.

A washing liquid including foreign substances may escape from the body 226 of the inlet guide 220 through the first outlet 224 and may flow into a vacant space inside the rotating filter 210.

Additionally, the first outlet 224 may be formed toward a part of an inner circumferential surface of the lateral surface portion 212 of the rotating filter 210 in a predetermined direction. The predetermined direction may denote a main direction in which a washing liquid including foreign substances is discharged through the first outlet 224, and may include a horizontal component and a vertical component.

The main direction may denote a direction in which a large amount of a washing liquid including foreign substances is discharged out of a total amount of the washing liquid including foreign substances discharged through the first outlet 224 or an average direction in which a total amount of a washing liquid including foreign substances is discharged through the first outlet 224. Additionally, the vertical direction may denote the up-down direction and the horizontal direction may denote a direction orthogonal to the up-down direction.

A horizontal component of the predetermined direction in which the first outlet 224 is formed, and a horizontal component of a direction from the first outlet 224 to the second outlet 234 may form a predetermined angle greater than 0 degrees.

For example, the first outlet 224, as in FIG. 17, may be formed toward a part of the inner circumferential surface of the lateral surface portion 212 of the rotating filter 210, i.e., a right side of the lateral surface portion 212 in FIG. 17 in a predetermined direction. The predetermined direction may correspond to a direction indicated by an arrow c1 near the first outlet 224 among directions indicated by arrows c1 showing a main flow direction of a washing liquid including foreign substances in FIGS. 17 and 18.

In FIG. 17 in which horizontal components are shown, the direction of the arrow c1 near the first outlet 224 may be a left-to-right direction. Accordingly, a horizontal component of the main direction in which a washing liquid including foreign substances is discharged through the first outlet 224 may correspond to a direction from the left to the right in FIG. 17.

In FIG. 18 in which vertical components are shown, the arrow c1 may indicate a downward direction near the first inlet 222 while indicating a direction parallel with the horizontal direction near the first outlet 224. Accordingly, there may be no vertical component of the main direction in which a washing liquid including foreign substances is discharged through the first outlet 224. That is, the vertical component may be 0.

Thus, the predetermined direction, which is faced by the first outlet 224 and in which the first outlet 224 is formed in FIGS. 17 and 18, may only include the horizontal component of the left-to-right direction in FIG. 17. That is, the predetermined direction may not include the vertical component.

In FIG. 17 in which the horizontal component is shown, a horizontal component of the direction from the first outlet 224 to the second outlet 234 may correspond to a right-to-left direction in FIG. 17.

Accordingly, in FIG. 17, the horizontal component (i.e., the left-to-right direction) of the predetermined direction, which is faced by the first outlet 224 and in which the first outlet 224 is formed, and the horizontal component (i.e., the right-to-left direction) of the direction from the first outlet 224 to the second outlet 234 may form a predetermined angle (i.e., about 180 degrees) greater than 0 degrees. However, the angle may not be limited. Description in relation to this is provided below with reference to FIGS. 19 and 20.

As described above, the first outlet 224 may be formed toward a part of the inner circumferential surface of the lateral surface portion 212 in a predetermined direction, and a horizontal component of the predetermined direction and a horizontal component of the direction from the first outlet 224 to the second outlet 234 may form a predetermined angle greater than 0 degrees.

Accordingly, a washing liquid discharged from the first outlet 224 and including foreign substances may be interrupted by a part of the inner circumferential surface of the lateral surface portion 212 disposed in the predetermined direction, and may be branched approximately into two (arrow c2 and arrow c3 in FIG. 17) with respect to the horizontal component and may flow.

The washing liquids branched into two may flow along the inner circumferential surface of the lateral surface portion 212 while being interrupted by the inner circumferential surface of the lateral surface portion 212, to flow to the second outlet 234. As in FIG. 17, the washing liquid with foreign substances, discharged from the first outlet 224, may flow along an inner circumferential surface of the filter sheet 212*b* of the lateral surface portion 212 approximately in the direction of the arrow c2 and the direction of the arrow c3, to flow to the second outlet 234.

The direction of the arrow c2 may be the same as a direction of an arrow f that is a direction of rotation of the rotating filter 210. However, the direction of the arrow c3 may be opposite to the direction of the arrow f that is the direction of rotation of the rotating filter 210.

That is, a washing liquid belonging to any one of the two branches and including foreign substances may flow along the inner circumferential surface of the lateral surface portion 212 of the rotating filter 210 in a direction (the direction of the arrow c3) opposite to the direction (the direction of the arrow f) of rotation of the rotating filter 210.

Accordingly, a difference between a speed at which the lateral surface portion 212 rotates and a speed at which the washing liquid including foreign substances flows along the inner circumferential surface of the lateral surface portion 212 may become great in a portion where the direction in which the rotating filter 210 rotates is opposite to the direction in which the washing liquid including foreign substances flows along the inner circumferential surface of the lateral surface portion 212 of the rotating filter 210.

As a result, in the portion where the direction in which the rotating filter 210 rotates is opposite to the direction in which the washing liquid including foreign substances flows along the inner circumferential surface of the lateral surface portion 212 of the rotating filter 210, a strong shear force may be applied to the inner circumferential surface of the lateral surface portion 212, and foreign substances s adhered to the lateral surface portion 212 may easily separate from the lateral surface portion 212.

With the simple configuration, the filter may be cleaned automatically and readily without incurring large costs. Thus, flow resistance may be reduced and energy efficiency may improve since the filter is not blocked by foreign substances. Further, the filter does not have to be cleaned manually, and costs incurred for managing and repairing the filter may be reduced.

When a dishwasher is equipped with the automatic cleaning filter, flow resistance may be reduced and durability of the dishwasher may improve. Additionally, since the filter is not blocked, a flow pressure and a flow rate of a washing liquid may not be reduced, thereby ensuring improvement in performance of the dishwasher, and the frequency or amount where a washing liquid used for removing foreign substances adhered to the filter is supplied and drained may be reduced, thereby reducing an amount of a washing liquid to be used. When the dishwasher heats a washing liquid and then uses the heated washing liquid, an amount of the washing liquid to be used may be reduced, and energy used for heating a washing liquid may be saved.

When the first outlet 224 is disposed outside the rotating filter 210 (e.g., the upper portion of the rotating filter), the first outlet 224 may incline in the up-down direction toward a part of the inner circumferential surface of the lateral surface portion 212. Accordingly, when the first outlet 224 is disposed outside the rotating filter 210, the predetermined direction in which the first outlet 224 is formed may necessarily include a vertical component.

The first outlet 224 may be disposed near a part of the inner circumferential surface of the lateral surface portion 212 of the rotating filter 210 arranged in the predetermined direction which is faced by the first outlet 224 and in which the first outlet 224 is formed. For example, as illustrated in FIGS. 17 and 18, the first outlet 224 may be disposed near a part of the inner circumferential surface of the lateral surface portion 212 of the rotating filter 210, i.e., a right side of the inner circumferential surface of the lateral surface portion 212 of the rotating filter 210 arranged in the predetermined direction in which the first outlet 224 is formed, i.e., the left-to-right direction. However, the configuration of the first outlet 224 may not be limited. Description in relation to this is provided below with reference to FIGS. 19 and 20.

Accordingly, a distance between a point, at which the washing liquid including foreign substances is discharged from the first outlet 224, and a point, at which the washing liquid including foreign substances is branched approximately into two with respect to the horizontal component as a result of interference of a part of the inner circumferential surface of the lateral surface portion 212, may decrease. Thus, a flow rate and a flow velocity of the washing liquid with foreign substances, branched into two and flowing along the inner circumferential surface of the lateral surface portion 212, may increase, and a stronger shear force may be applied to the inner circumferential surface of the lateral surface portion 212, thereby separating foreign substances s adhered to the lateral surface portion 212 from the lateral surface portion 212 more readily and effectively, and generation of an eddy may be suppressed, thereby reducing flow resistance. With the simple configuration, the filter may be cleaned effectively and readily without incurring large costs.

The first outlet 224 may be disposed in a direction approximately opposite to a direction of the second outlet 234 with respect to the rotation axis A. However, the configuration of the first outlet 224 may not be limited.

Accordingly, distances respectively moved by a washing liquid with foreign substances, which is branched approximately into two with respect to the horizontal component as a result of interference by a part of the inner circumferential surface of the lateral surface portion 212 after the washing liquid with foreign substances is discharged from the first outlet 224, along the inner circumferential surface of the lateral surface portion 212 may become similar, and flow rates of the washing liquids branched into two may become similar, in order for two branches of the washing liquid to flow to the second outlet 234. Thus, the washing liquid with foreign substances may flow uniformly and stably, thereby suppressing generation of an eddy and reducing flow resistance. With the simple configuration, the filter may be cleaned automatically and readily without incurring large costs.

The first outlet 224, as illustrated in the drawing, may be formed in a way that the first outlet 224 is long in the up-down direction toward the inner circumferential surface of the lateral surface portion 212. However, the configuration of the first outlet 224 may not be limited.

Accordingly, a flow cross-sectional area, in which a washing liquid including foreign substances can flow, may increase, and flow resistance may decrease. Additionally, since the washing liquid with foreign substances, flowing along the inner circumferential surface of the lateral surface portion 212, may flow stably in the up-down direction, foreign substances s adhered to the lateral surface portion 212 may separate from the lateral surface portion 212 more readily, and generation of an eddy may be suppressed, thereby reducing flow resistance. With the simple configuration, the filter may be cleaned automatically and effectively without incurring large costs.

The body 226 may be provided with a vacant space therein, and may have a first inlet 222 and a first outlet 224 at an end such as an upper end or a lateral end and the like thereof.

The body 226 may connect the first inlet 222 and the first outlet 224, and the predetermined direction faced by the first outlet 224 may be determined depending on a direction faced by the body 226 near the first outlet 224.

The body 226, as illustrated in the drawing, may be disposed at least partially inside the rotating filter 210, and may be elongated toward a second outlet 234. For example, as in FIGS. 17 and 18, a part of the body 226 may be disposed inside the rotating filter 210, and may be elongated toward a left side on which the second outlet 234 is arranged.

Accordingly, the inlet guide 220 may separate a first area a1 described below from a second area a2 described below in place of a flow partition 260 described below. Accordingly, an automatic cleaning device may be manufactured easily and simply without incurring large costs, using a minimum number of parts.

Additionally, as the body 226 is elongated toward the second outlet 234, the vacant space in the body 226 connecting the first inlet 222 and the first outlet 224 may expand toward the second outlet 234, and the first inlet 222 may expand toward the second outlet 234.

Accordingly, a flow cross-sectional area, in which a washing liquid including foreign substances can flow, may increase, and flow resistance may decrease. With the simple configuration, the filter may be cleaned automatically, effectively and readily without incurring large costs.

The body 226 may have an inclined surface 227 (FIG. 16) to facilitate a flow from the first inlet 222 to the first outlet 224, there inside.

As a predetermined vacant space inside the rotating filter 210 surrounded by the lateral surface portion 212 of the rotating filter 210, a vacant space between the rotating filter 210 and the inlet guide 220 may be divided into a first area a1 and a second area a2 with respect to a virtual partition P that connects a part of the inner circumferential surface of the rotating filter 210, disposed in the predetermined direction which is faced by the first outlet 224 and in which the first outlet 224 is formed, and the second outlet 234 and that extends in the up-down direction.

For example, in FIG. 17, as a predetermined vacant space inside the rotating filter 210 surrounded by the lateral surface portion 212 of the rotating filter 210, the vacant space between the rotating filter 210 and the inlet guide 220 may be divided into a first area a1 and a second area a2 with respect to a virtual partition P that connects a part of the inner circumferential surface of the rotating filter 210, i.e., the right lateral surface portion of the inner circumferential surface of the rotating filter 210 disposed in the predetermined direction which is faced by the first outlet 224 and in which the first outlet 224 is formed, i.e., the left-to-right direction, and the second outlet 234 and that extends in the up-down direction.

In the first area a1, at least a portion of the washing liquid including foreign substances may flow in a direction c2 approximately the same as the direction f in which the rotating filter 210 rotates, along the inner circumferential surface of the lateral surface portion 212. In the second area a2, at least a portion of the washing liquid including foreign substances may flow in a direction c3 approximately opposite to the direction f in which the rotating filter 210 rotates, along the inner circumferential surface of the lateral surface portion 212.

A flow partition 260 including a first side portion 262*a* facing the first area a1 and a second side portion 262*b* facing the second area a2 may be disposed between the first area a1 and the second area a2. Description in relation to this is provided below with reference to FIGS. 22 and 23.

As illustrated in FIGS. 17 and 18, the body 226 may be substituted for the flow partition 260 described below. That is, the body 226 may be arranged between the first area a1 and the second area a2 and may include a first side portion 226*a* of the body 226, facing the first area a1, and a second side portion 226*b* of the body 226, facing the second area a2.

Accordingly, since the inlet guide 220 may be substituted for the flow partition 260 described below, an automatic cleaning device may be manufactured easily and simply without incurring large costs using a minimum number of parts.

The inlet guide 220 may divide the first area a1 and the second area a2 to prevent a flow in each area from mixing. Accordingly, washing liquids with foreign substances, branched into two and flowing along different inner circumferential surfaces of the lateral surface portion 212, may flow stably in different directions c2, c3. Thus, foreign substances s adhered to the lateral surface portion 212 may separate from the lateral surface portion 212 more readily, and generation of an eddy may be suppressed, thereby reducing flow resistance. With the simple configuration, the filter may be cleaned automatically and effectively without incurring large costs.

The second area a2 may be greater than the first area a1 depending on a position or a shape of the body 226. For example, the first side portion 226*a* of the body 226 may protrude convexly, as illustrated in the drawing. That is, the first side portion 226*a* of the body 226 may protrude convexly toward the lateral surface portion 212 of the rotating filter 210.

Accordingly, the first area a1 may become narrow, and generation of an eddy in the first area a1 may be suppressed, thereby preventing foreign substances s from being collected in the first area. Thus, an increase in flow resistance caused by tangled-up and scaled-up foreign substances s inserted in the space between the rotating filter 210 and the body 226 facing the second outlet 234 may be prevented. With the simple configuration, the filter may be cleaned automatically and readily without incurring large costs.

Further, the vacant space in the body 226 connecting the first inlet 222 and the first outlet 224 may expand toward the first area a1, and the first inlet 222 may expand/extend toward the first area a1. Accordingly, the flow cross-sectional area, in which a washing liquid including foreign substances can flow, may increase, and flow resistance may decrease. With the simple configuration, the filter may be cleaned automatically and readily without incurring large costs.

The first side portion 226*a* of the body 226 may be spaced a predetermined distance apart from the inner circumferential surface of the lateral surface portion 212 of the rotating filter 210 and formed inside the rotating filter 210 along the inner circumferential surface.

Accordingly, the washing liquid with foreign substances, flowing along the inner circumferential surface of the lateral surface portion 212 of the rotating filter 210 in the first area a1, may keep flowing stably, thereby reducing flow resistance. Additionally, the first area a1 may become narrow, and generation of an eddy in the first area a1 may be suppressed, thereby preventing foreign substances s from being collected in the first area. Further, the vacant space in the body 226 connecting the first inlet 222 and the first outlet 224 may expand toward the first area a1. With the simple configuration, the filter may be cleaned automatically and readily without incurring large costs.

In the first area a1, since a direction, in which a washing liquid including foreign substances flows along the inner circumferential surface of the lateral surface portion 212 of the rotating filter 210, is the same as the direction in which the rotating filter 210 rotates, a flow velocity in the first area a1 may be greater than a flow velocity in the second area a2.

Accordingly, a total amount of a washing liquid with foreign substances, flowing respectively in the first area a1 and the second area a2, may become identical even though the first area a1 is narrower than the second area a2 and the flow cross-sectional area becomes narrow. Thus, a pressure in the first area a1 and a pressure in the second area a2 may be balanced. As a result, flow resistance may not increase even though the first area a1 is narrower than the second area a2 and the flow cross-sectional area becomes narrow.

In the second area a2, since a direction, in which a washing liquid with foreign substances flows along the inner circumferential surface of the lateral surface portion 212 of the rotating filter 210, may be opposite to the direction in which the rotating filter 210 rotates, a strong shear force may be applied to the inner circumferential surface of the lateral surface portion 212, and foreign substances s adhered to the lateral surface portion 212 may readily separate from the lateral surface portion 212. Accordingly, the second area a2 requires a space for collecting foreign substances s.

When the second area a2 is greater than the first area a1 depending on the position or shape of the body 226 as described above, the second area a2 may have a space for collecting foreign substances s.

Since the second area a2 becomes wide, an eddy c4 (FIG. 17) may be generated in the second area a2. Accordingly, foreign substances s may be readily collected in the second area a2. With the simple configuration, the filter may be cleaned automatically and effectively without incurring large costs.

In the second area a2, since the direction, in which a washing liquid including foreign substances flows along the inner circumferential surface of the lateral surface portion 212 of the rotating filter 210, is opposite to the direction in which the rotating filter 210 rotates, an eddy may be generated. Accordingly, the foreign substances s may be prevented from flowing between the rotating filter 210 and the body 226 facing the second outlet 234 even though the foreign substances s are collected and scaled up as a result of generation of an eddy. Thus, an increase in flow resistance caused by the foreign substances s inserted in the space between the rotating filter 210 and the body 226 facing the second outlet 234 may be prevented.

The second side portion 226*b* of the body 226 may include a flat surface shape approximately parallel with the virtual partition P. Accordingly, the second area a2 may become greater than the first area a1.

The second side portion 226*b* of the body 226 may include a section in which a distance from the lateral surface portion 212 of the rotating filter 210, surrounding the second area a2, gradually increases and then decreases further toward the first outlet 224 or the second outlet 234. Accordingly, the second area a2 may have a space for collecting foreign substances s. Description in relation to this is provided below with reference to FIGS. 24 and 25.

A portion of the body 226, facing the second outlet 234, may be formed to cover the second outlet 234 entirely. Accordingly, the foreign substances s collected in the second area a2 may be prevented from keeping moving to the first area a1 or the foreign substances s collected in the first area a1 may be prevented from keeping moving to the second area a2 such that the foreign substances s are prevented from being adhered to the rotating filter 210 facing the second outlet 234, thereby reducing flow resistance effectively. With the simple configuration, the filter may be cleaned automatically, effectively and readily without incurring large costs. Description in relation to this is provided below with reference to FIGS. 22 to 24.

The second groove 228 (FIG. 16) may be formed on a lower surface of the body 226. The first projection 218 (FIGS. 12 to 16) of the rotating filter 210 may be inserted into the second groove 228. Accordingly, the inlet guide 220 may be stably supported. \

[Filter Housing]

The filter housing 230 may be disposed outside the rotating filter 210, and may include a housing wall 232, a second outlet 234, a discharge opening 236, a first through hole 238 and a second through hole 239. The filter housing 230 may be fixed.

The housing wall 232 may surround the lateral surface portion 212 of the rotating filter 210.

For example, the housing wall 232 may be spaced a predetermined distance apart from the outer circumferential surface of the lateral surface portion 212 of the rotating filter 210 along the outer circumferential surface of the lateral surface portion 212 of the rotating filter 210 and may be formed outside the rotating filter 210.

Accordingly, a washing liquid, which flows between the housing wall 232 and the lateral surface portion 212 of the rotating filter 210 and from which foreign substances are filtered, may support the washing liquid with foreign substances, which flows along the inner circumferential surface of the lateral surface portion 212 of the rotating filter 210 in the first area a1 and the second area a2. Thus, the washing liquid with foreign substances, flowing along the inner circumferential surface of the lateral surface portion 212 of the rotating filter 210, may keep flowing stably. With the simple configuration, the filter may be cleaned automatically and readily without incurring large costs.

The second outlet 234 may be formed in a way that passes through the housing wall 232 and may connect to the washing pump 150.

The second outlet 234 may discharge the washing liquid from which foreign substances are filtered by the rotating filter 210 outward.

The discharge opening 236 may be formed in a way that passes through a lower portion of the housing wall 232 or a lower portion of the filter housing 230, and may connect to the drainage channel 24 and the drainage pump 25.

The discharge opening 236 may discharge the foreign substances, which are left inside the lateral surface portion 212 of the second area a2 and the like without passing through the filter sheet 212*b* (FIGS. 17 and 18) of the lateral surface portion 212 of the rotating filter 210, out of the automatic cleaning filter 200.

The first through hole 238 may be formed in a way that passes through the lower portion of the filter housing 230 in the up-down direction, and the rotating shaft 272 of the driver 270 may pass through and be inserted into the first through hole 238.

The second through hole 239 may be formed in a way that passes through the housing wall 232, and the washing nozzle 242 of the water supply portion 240 may be inserted into the second through hole 239. Accordingly, the washing nozzle 242 may be disposed on the housing wall 232.

[Water Supply Portion]

The water supply portion 240 may include a washing nozzle 242, a water supply opening 244, and a second body 246.

The washing nozzle 242 may be formed on the second body 246 and inserted into the second through hole 239 of the housing wall 232. The washing nozzle 242 may spray a washing liquid toward the rotating filter 210.

Accordingly, since the washing nozzle 242 may spray a washing liquid toward the outer circumferential surface of the lateral surface portion 212 from the outside of the rotating filter 210, the foreign substances adhered to the inner circumferential surface of the lateral surface portion 212 may be readily taken away toward the inside of the lateral surface portion 212. With the simple configuration, the filter may be cleaned automatically and effectively without incurring large costs.

The washing nozzle 242 may be dispose to face the first outlet 224, and may spray a washing liquid in a direction opposite to the predetermine direction which is faced by the first outlet 224 and in which the first outlet 224 is formed.

Accordingly, even though the washing nozzle 242 sprays a washing liquid, the washing liquid may readily separate foreign substances s from the lateral surface portion 212 without interfering with flows of washing liquids with foreign substances, flowing along the inner circumferential surface of the lateral surface portion 212 of the rotating filter 210 in different directions in the first area a1 and the second area a2. With the simple configuration, the filter may be cleaned automatically and effectively without incurring large costs.

The washing nozzle 242 may be long in the up-down direction and formed toward the outer circumferential surface of the lateral surface portion 212.

Accordingly, although the washing nozzle 242 sprays a washing liquid, the washing liquid with foreign substances, flowing along the inner circumferential surface of the lateral surface portion 212 in the first area a1 and the second area a2, may keep flowing stably in the up-down direction. As a result, the foreign substances s adhered to the lateral surface portion 212 may separate from the lateral surface portion 212 more readily, and generation of an eddy may be suppressed, thereby reducing flow resistance. With the simple configuration, the filter may be cleaned automatically and effectively without incurring large costs.

The water supply opening 244 may be formed on the second body 246 and may connect to the water supply channel 23 and the water supply valve 22.

The water supply opening 244 may allow a clean washing liquid supplied by an external water source to flow into the second body 246.

The second body 246 may be arranged on the housing wall 232, and may connect the water supply opening 244 and the washing nozzle 242.

[Filter]

A filter 250 may be disposed on top of the first inlet 222. The filter 250 may include a plurality of second holes 252 having a size greater than a size of the first hole 213 formed in the rotating filter 210.

Accordingly, since the filter 250 filters foreign substances before a washing liquid including the foreign substances flows into the rotating filter 210, the rotating filter 210 may be cleaned automatically, effectively and readily without incurring large costs with the simple configuration.

[Flow Partition]

A flow partition 260 may be replaced with the body 226 of the inlet guide 220. The flow partition 260 is described below with reference to FIGS. 22 and 23.

[Driver]

A driver 270 (FIG. 18) may be installed under the filter housing 230, and may include a rotating shaft 272. The driver 270 (FIG. 18) may rotate the rotating filter 210 in one direction.

The rotating shaft 272 may pass through and be inserted into the first through hole 238 of the filter housing 230, and may be inserted into and coupled to the first groove 219 (FIGS. 11 and 16) of the rotating filter 210.

Figure 19:
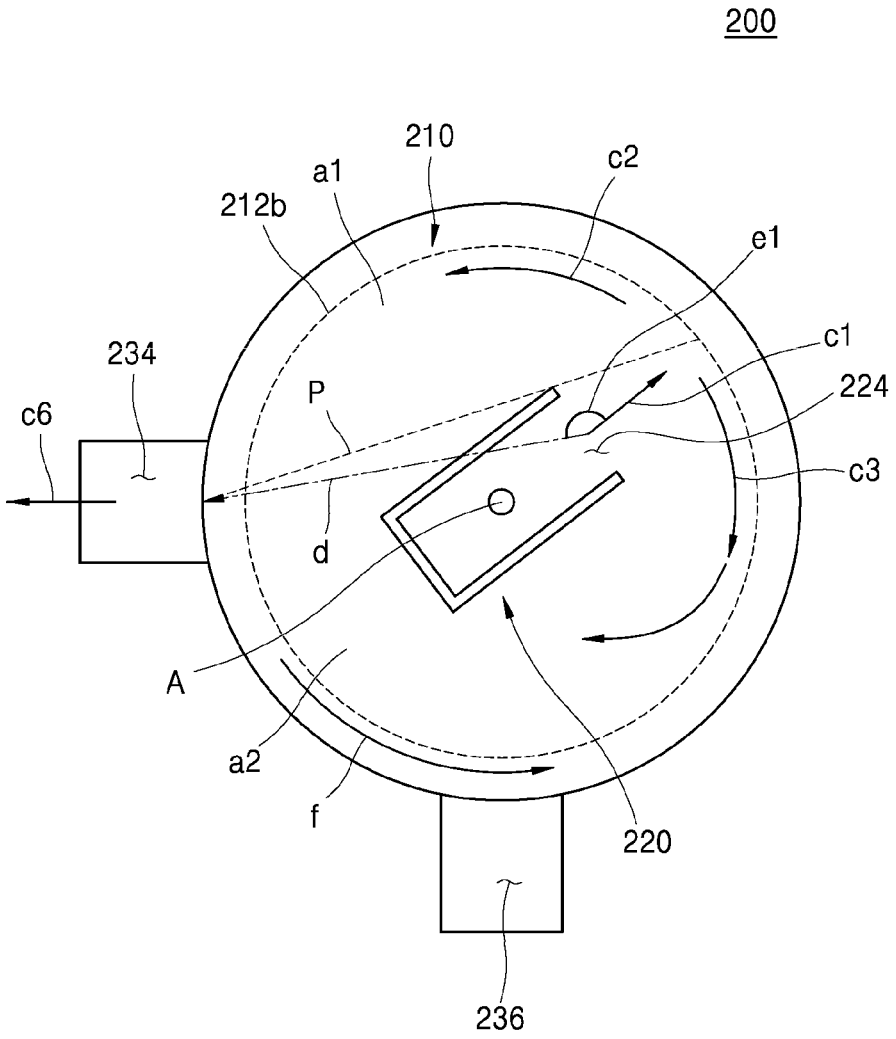
FIGS. 19 and 20 are schematic views showing a state in which an automatic cleaning filter in another embodiment operates.
Figure 20:
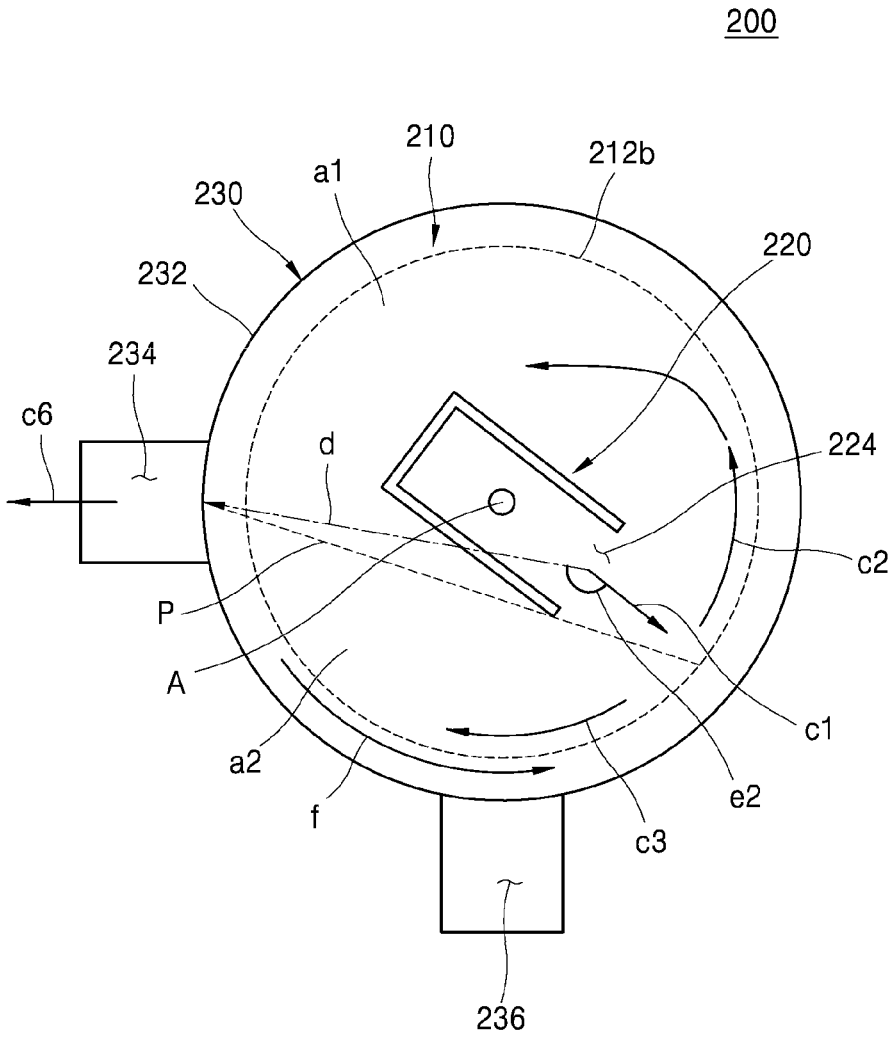

FIGS. 19 and 20 are schematic views showing a state in which an automatic cleaning filter in another embodiment operates.

Referring to FIGS. 19 and 20, in the automatic cleaning filter of another embodiment, a horizontal component c1 of the predetermined direction which is faced by the first outlet 224 and in which the first outlet 224 is formed, and a horizontal component d of the direction from the first outlet 224 to the second outlet 234 may form an angle e1, e2 that is an obtuse angle greater than 90 degrees and less than 180 degrees. The angle formed between the horizontal components in another embodiment may differ from an angle formed between the horizontal components in the embodiment of FIGS. 1 to 18.

Although the angle e1, e2 is an obtuse angle, a shear force may be applied to the inner circumferential surface of the lateral surface portion 212 in the second area a2 where the direction f of rotation of the rotating filter 210 is opposite to the direction c2, c3 in which at least a portion of the washing liquid including foreign substances flows along the inner circumferential surface of the lateral surface portion 212 of the rotating filter 210, thereby readily separating foreign substances s adhered to the lateral surface portion 212 from the lateral surface portion 212.

When the angle e1, e2 is an obtuse angle, distances respectively moved by a washing liquid with foreign substances, which is branched approximately into two c2, c3, along the inner circumferential surface of the lateral surface portion 212 may differ in order for two branches of the washing liquid to flow to the second outlet 234.

Accordingly, the washing liquid including foreign substances may flow non-uniformly, an eddy may be generated, and a distance actually moved by the washing liquid including foreign substances along the inner circumferential surface of the lateral surface portion 212 of the rotating filter 210 may decrease. Thus, flow resistance may increase, and a distance at which a shear force is applied in the second area a2 may decrease, thereby reducing washing performance of the automatic cleaning filter.

When the angle e1, e2 is about 180 degrees as illustrated in FIGS. 1 to 18, the above problem may be solved. That is, when the angle e1, e2 is about 180 degrees, the washing liquid including foreign substances may flow uniformly, generation of an eddy may be suppressed, and a distance moved by the washing liquid including foreign substances along the inner circumferential surface of the lateral surface portion 212 of the rotating filter 210 may increase. Accordingly, flow resistance may decrease, and a distance at which a shear force is applied in the second area a2 may increase, thereby improving washing performance of the automatic cleaning filter. With the simple configuration, the filter may be cleaned automatically, effectively and readily without incurring large costs.

Although the angle e1, e2 is an acute angle unlike the angle in FIGS. 18 and 19, a shear force may be applied to the inner circumferential surface of the lateral surface portion 212 in the second area a2 where the direction f of rotation of the rotating filter 210 is opposite to the direction c2, c3 in which a washing liquid including foreign substances flows at least partially along the inner circumferential surface of the lateral surface portion 212 of the rotating filter 210, thereby readily separating foreign substances s adhered to the lateral surface portion 212 from the lateral surface portion 212.

When the angle e1, e2 is an acute angle, the above problem, which occurs when the angle e1, e2 is an obtuse angle less than 180 degrees, may occur. The washing liquid including foreign substances may flow more non-uniformly at an acute angle e1, e2 than an obtuse angle e1, e2, thereby further reducing the washing performance of the automatic cleaning filter.

Accordingly, the washing performance of the automatic cleaning filter may improve further at an obtuse angle e1, e2 than an acute angle e1, e2, as illustrated in FIGS. 19 and 20. That is, the flow resistance may decrease, and the distance at which a shear force is applied in the second area a2 may increase, thereby improving the washing performance of the automatic cleaning filter. With the simple configuration, the filter may be cleaned automatically and readily without incurring large costs.

Unlike the first outlet in FIGS. 1 to 18, the first outlet 224 in FIGS. 19 and 20 may be disposed near the rotation axis A of the rotating filter 210 instead of being disposed near a part of the inner circumferential surface of the lateral surface portion 212 of the rotating filter 210 arranged in the predetermined direction c1 which is faced by the first outlet 224 and in which the first outlet 224 is formed.

In this case, a distance between a point at which the washing liquid including foreign substances is discharged from the first outlet 224, and a point at which the washing liquid including foreign substances is branched approximately into two c2, c3 with respect to the horizontal component as a result of interference by a part of the inner circumferential surface of the lateral surface portion 212 may increase. Accordingly, since a flow rate and a flow velocity of the washing liquid with foreign substances, branched into two c2, c3 and flowing along the inner circumferential surface of the lateral surface portion 212, may decrease, a weak shear force may be applied to the inner circumferential surface of the lateral surface portion 212. As a result, foreign substances s adhered to the lateral surface portion 212 may not easily separate from the lateral surface portion 212, and an eddy may be generated, resulting in an increase in flow resistance.

Thus, the first outlet 224, as illustrated in FIGS. 1 to 18, may be disposed near a part of the inner circumferential surface of the lateral surface portion 212 of the rotating filter 210 disposed in the predetermined direction which is faced by the first outlet 224 and which the first outlet 224 is formed, for example.

Figure 21:
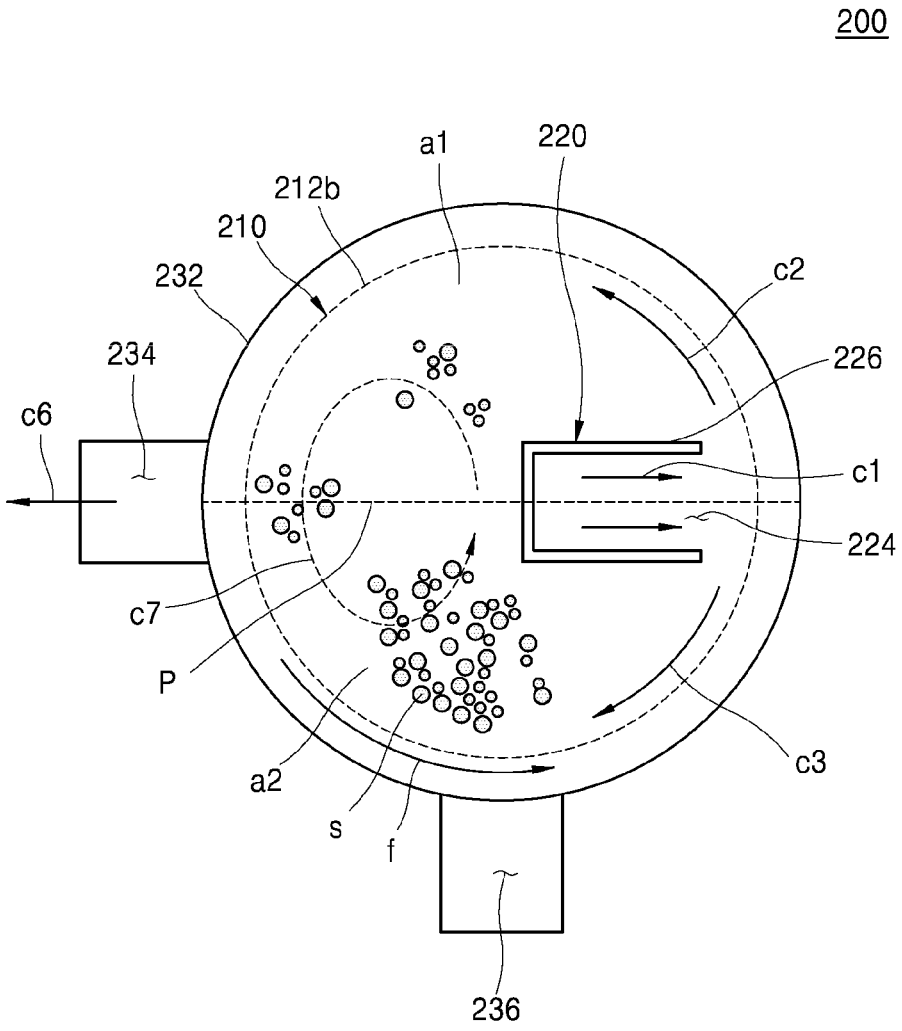
FIG. 21 is a schematic view showing a state in which an automatic cleaning filter in another embodiment operates.

FIG. 21 is a schematic view showing a state in which an automatic cleaning filter in another embodiment operates.

Referring to FIG. 21, unlike the automatic cleaning filter in FIGS. 1 to 18, the automatic cleaning filter in another embodiment may be provided with a body 226 of an inlet guide 220, which is not elongated toward the second outlet 234. In this case, an eddy c7 in which foreign substances s flow may be formed between the first area a1 and the second area a2. Accordingly, the foreign substances s collected in the second area a2 may keep moving to the first area a1 or the foreign substances s collected in the first area a1 may keep moving to the second area a2, and the foreign substances s may be adhered to the lateral surface portion 212 of the rotating filter 210 facing the second outlet 234, thereby increasing flow resistance.

Thus, the flow partition 260 separating the first area a1 from the second area a2 may be disposed between the first area a1 and the second area a2, for example. Description in relation to this is provided with reference to FIG. 22.

Figure 22:
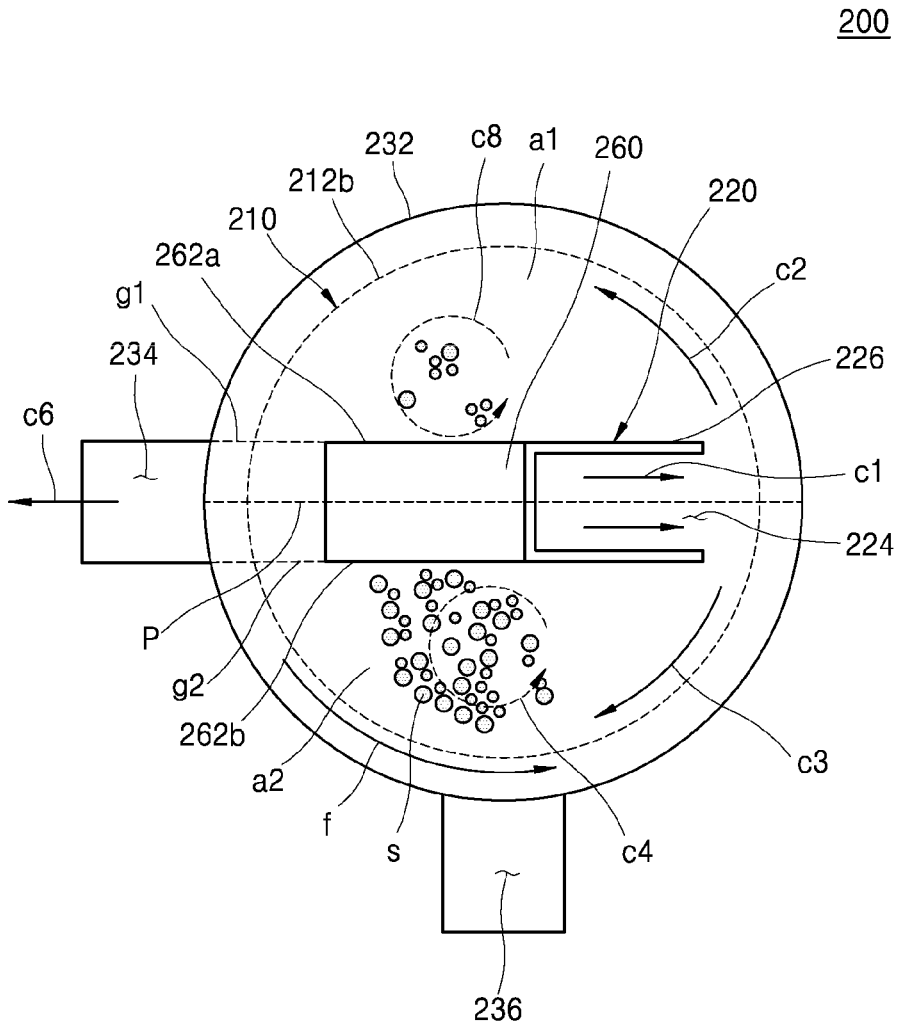
FIG. 22 is a schematic view showing a state in which an automatic cleaning filter in another embodiment operates.

FIG. 22 is a schematic view showing a state in which an automatic cleaning filter in another embodiment operates.

Referring to FIG. 22, unlike the automatic cleaning filter in FIG. 21, the automatic cleaning filter in another embodiment may be provided with a flow partition 260.

The flow partition 260 may be disposed between the first area a1 and the second area a2, and may include a first side portion 262*a* facing the first area a1 and a second side portion 262*b* facing the second area a2.

Accordingly, the flow partition 260 may be disposed between the first area a1 and the second area a2 and may separate the first area a1 from the second area a2, to prevent a flow in each area from mixing. That is, the flow partition 260 may prevent formation of an eddy c7 (FIG. 21), in which foreign substances s flow, between the first area a1 and the second area a2.

Thus, the washing liquid with foreign substances, branched into two c2, c3 and flowing along a different inner circumferential surface of the lateral surface portion 212, may flow stably in a different direction c2, c3, foreign substances s adhered to the lateral surface portion 212 may separate from the lateral surface portion 212 more readily, and generation of an eddy may be suppressed, thereby reducing flow resistance. With the simple configuration, the filter may be cleaned automatically and effectively without incurring large costs.

When the flow partition 260 is disposed between the first area a1 and the second area a2 and separates the first area a1 from the second area a2, an eddy c8 may be generated in the first area a1. Accordingly, foreign substances s may be collected, tangled up and scaled up in the first area a1, and the scaled-up foreign substances s may be inserted in the space between the rotating filter 21 and the flow partition 260 facing the second outlet 234, causing an increase in the flow resistance. To prevent this from happening, a space in which an eddy c8 may be generated may be reduced in the first area a1, for example.

Since the direction f of rotation of the rotating filter 210 is opposite to the direction c3 in which a washing liquid including foreign substances flows along the inner circumferential surface of the lateral surface portion 212 of the rotating filter 210, in the second area a2, a strong shear force may be applied to the inner circumferential surface of the lateral surface portion 212, thereby readily separating foreign substances s adhered to the lateral surface portion 212 from the lateral surface portion 212. In this case, the second area a2 requires a space for collecting the foreign substances s.

Since the direction f of rotation of the rotating filter 210 is opposite to the direction c3 in which a washing liquid including foreign substances flows along the inner circumferential surface of the lateral surface portion 212 of the rotating filter 210, in the second area a2, foreign substances s may be prevented from flowing between the rotating filter 210 and the flow partition 260 facing the second outlet 234 although the foreign substances s are collected and scaled up. Accordingly, an increase in the flow resistance caused by the foreign substances s inserted in the space between the rotating filter 210 and the flow partition 260 facing the second outlet 234 may be prevented.

Thus, the second area a2 may be greater than the first area a1 depending on a position or a shape of the flow partition 260. Description in relation to this is provided with reference to FIG. 23.

Figure 23:
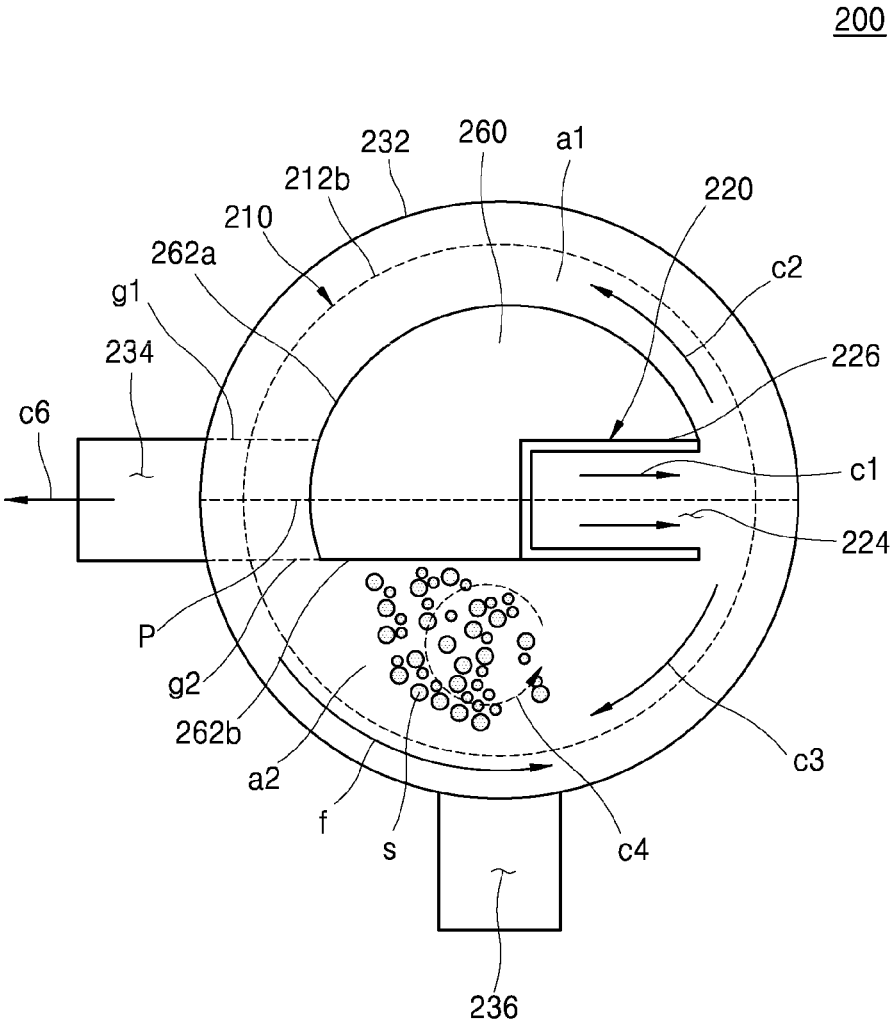
FIG. 23 is a schematic view showing a state in which an automatic cleaning filter in another embodiment operates.

FIG. 23 is a schematic view showing a state in which an automatic cleaning filter in another embodiment operates.

Referring to FIG. 23, unlike the flow partition of the automatic cleaning filter in FIG. 22, the flow partition 260 of the automatic cleaning filter in another embodiment may be formed asymmetrically with respect to the virtual partition P. That is, the second area a2 may be greater than the first area a1 depending on a position or a shape of the flow partition 260.

A first side portion 262*a* of the flow partition 260, as illustrated in FIG. 23, may protrude convexly. That is, the first side portion 262*a* of the flow partition 260 may protrude convexly toward the lateral surface portion 212 of the rotating filter 210.

Accordingly, the first area a1 may become narrow, and an eddy c8 (FIG. 22) may be prevented from being generated in the first area a1, and foreign substances s may be prevented from being collected in the first area a1. Thus, an increase in the flow resistance caused by the tangled-up and scaled-up foreign substances s inserted in the space between the rotating filter 210 and the flow partition 260 facing the second outlet 234 may be prevented. With the simple configuration, the filter may be cleaned automatically, effectively and readily without incurring large costs.

Additionally, the first side portion 262*a* of the flow partition 260 may be spaced a predetermined distance apart from the inner circumferential surface of the lateral surface portion 212 of the rotating filter 210 along the inner circumferential surface of the lateral surface portion 212 of the rotating filter 210, inside the rotating filter 210.

Accordingly, since the washing liquid with foreign substances, flowing along the inner circumferential surface of the lateral surface portion 212 of the rotating filter 210 in the first area a1, may keep flowing stably, thereby reducing flow resistance. Additionally, the first area a1 may become narrow, and generation of an eddy in the first area a1 may be suppressed, thereby preventing foreign substances s from being collected in the first area. With the simple configuration, the filter may be cleaned automatically and readily without incurring large costs.

When the second area a2 is greater than the first area a1 depending on a position or a shape of the flow partition 260 as described above, the second area a2 may have a space for collecting foreign substances. Additionally, as the second area a2 becomes wide, an eddy c4 may be generated in the second area a2. Accordingly, foreign substances s may be easily collected in the second area a2. With the simple configuration, the filter may be cleaned automatically and effectively without incurring large costs.

A second side portion 262*b* of the flow partition 260, as illustrated in FIG. 23, may include a flat surface shape approximately parallel with the virtual partition P. Accordingly, the second area a2 may be greater than the first area a1.

As illustrated in FIGS. 22 and 23, a portion of the flow partition 260, facing the second outlet 234, may be formed to cover the second outlet 234 entirely. For example, an extension line g1, g2 may extend along a direction opposite to a main direction c6, in which a washing liquid is discharged through the second outlet 234, from both widthwise ends of the second outlet 234 on a horizontal surface to meet an end near the second outlet 234 of the flow partition 260.

The main direction may denote a direction in which out of a total amount of a washing liquid discharged through the second outlet 234, a large amount of the washing liquid is discharged or an average direction in which a total amount of a washing liquid is discharged.

Accordingly, the foreign substances s collected in the second area a2 may be prevented from keeping moving to the first area a1 or the foreign substances s collected in the first area a1 may be prevented from keeping moving to the second area a2 such that the foreign substances s are prevented from being adhered to the rotating filter 210 facing the second outlet 234, thereby reducing flow resistance effectively. With the simple configuration, the filter may be cleaned automatically, effectively and readily without incurring large costs.

Figure 24:
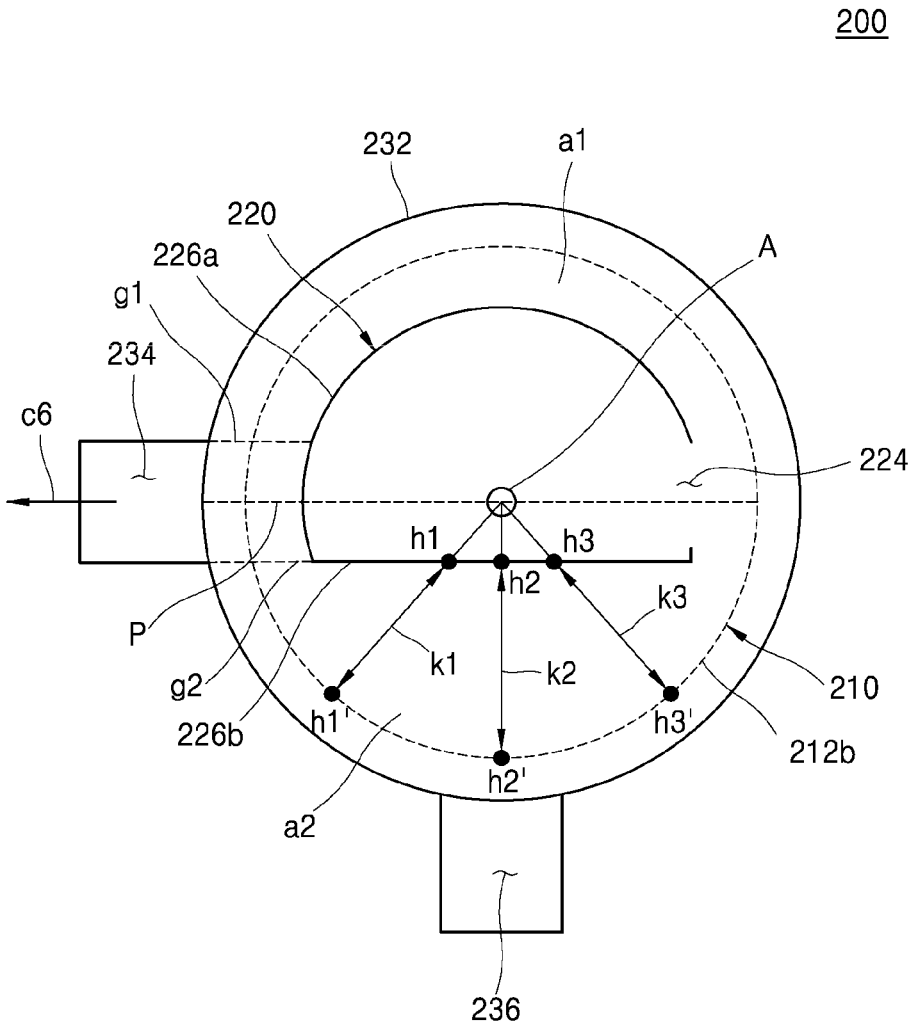
FIG. 24 is a schematic view showing the automatic cleaning filter in FIGS. 2 to 18.

FIG. 24 is a schematic view showing the automatic cleaning filter in FIGS. 2 to 18, and FIG. 25 is a schematic view showing an automatic cleaning filter in yet another embodiment.

Referring to FIG. 24, the automatic cleaning filter in one embodiment differs from the automatic cleaning filter in FIG. 23 in that the body 226 is substituted for the flow partition 260.

A portion of the body 226, facing the second outlet 234, may be formed to cover the second outlet 234 entirely like a portion of the flow partition 260, facing the second outlet 234, in FIG. 23. For example, an extension line g1, g2 may extend along a direction opposite to the direction c6, in which a washing liquid is discharged through the second outlet 234, from both widthwise ends of the second outlet 234 on a horizontal surface to meet an end near the second outlet 234 of the body 226.

A second side portion 226*b* of the body 226 may include a section in which a distance from the lateral surface portion 212 of the rotating filter 210, surrounding the second area a2, gradually increases and then decreases further toward the first outlet 224 or the second outlet 234. The distance may denote a minimum distance.

In FIG. 24, the minimum distance from the lateral surface portion 212 of the rotating filter 210, surrounding the second area a2, may gradually increase from k1 to k2 along the second side portion 226*b* of the body 226 from a dot h1 toward a dot h2, and the minimum distance from the lateral surface portion 212 of the rotating filter 210, surrounding the second area a2, may gradually decrease from k2 to k3 along the second side portion 226*b* of the body 226 from the dot h2 toward a h3, for example.

That is, the second side portion 226*b* of the body 226 may include the section, in which a distance from the lateral surface portion 212 of the rotating filter 210, surrounding the second area a2, gradually increases and then decreases further toward the first outlet 224 from the dot h1 to the dot h3, i.e., the section between the dot h1 to the dot h3.

Accordingly, the second area a2 may have a space for collecting foreign substances s and may become greater than the first area a1.

The minimum distance is described hereunder.

In FIG. 24, the lateral surface portion 212 of the rotating filter 210 may have a circular cross section, and a dot h1' may be on a circumference of the rotating filter 210. Additionally, the dot h1 may be on a straight line connecting a center A of the rotating filter 210 and the dot hr. A circle that takes the dot h1 as a center, and the straight line connecting the dot h1 and the dot h1' as a radius may correspond to an inscribed circle of the cross section of the lateral surface portion 212 of the rotating filter 210. Accordingly, k1 corresponding to the straight line between the dot h1 and the dot h1' may be a minimum distance between the dot h1 and the lateral surface portion 212 of the rotating filter 210. Likewise, k2 may correspond to a minimum distance between the dot h2 and the lateral surface portion 212 of the rotating filter 210, and k3 may correspond to a minimum distance between the dot h3 and the lateral surface portion 212 of the rotating filter 210.

Thus, the second area a2 may have a space for collecting foreign substances s. The second area a2 may become greater than the first area a1.

The second side portion 262*b* of the flow partition 260, as illustrated in FIG. 23, may include a section in which a distance from the lateral surface portion 212 of the rotating filter 210, surrounding the second area a2, gradually increases and then decreases further toward the first outlet 224 or the second outlet 234. Accordingly, the second area a2 may have a space for collecting foreign substances s. The second area a2 may become greater than the first area a1.

Figure 25:
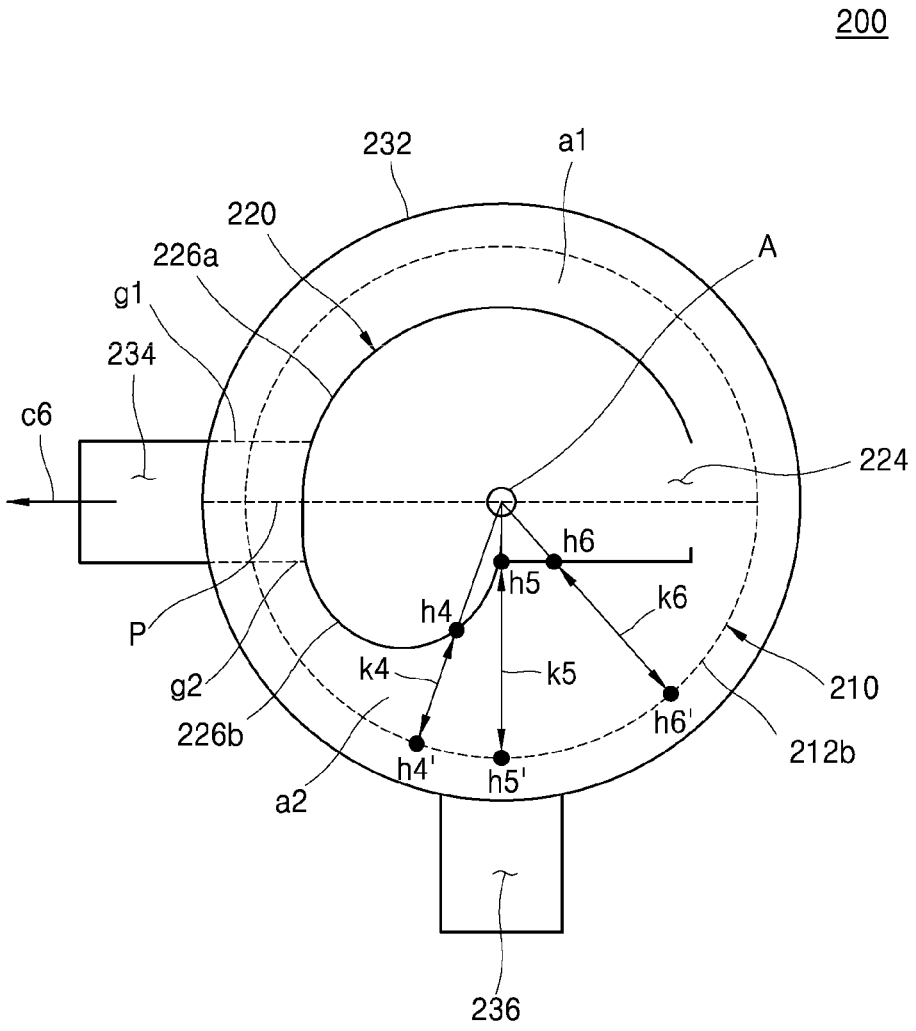
FIG. 25 is a schematic view showing an automatic cleaning filter in yet another embodiment.

Referring to FIG. 25, the automatic cleaning filter in yet another embodiment differs from the automatic cleaning filter in FIG. 24 in that the second side portion 226*b* of the body 226 has a different shape.

The second side portion 226*b* of the body 226 may include a section in which a distance from the lateral surface portion 212 of the rotating filter 210, surrounding the second area a2, gradually increases and then decreases further toward the first outlet 224 or the second outlet 234. The distance may denote a minimum distance.

In FIG. 25, the minimum distance from the lateral surface portion 212 of the rotating filter 210, surrounding the second area a2, may gradually increase from k4 to k5 along the second side portion 226*b* of the body 226 from a dot h4 toward a dot h5, and the minimum distance from the lateral surface portion 212 of the rotating filter 210, surrounding the second area a2, may gradually decrease from k5 to k6 along the second side portion 226*b* of the body 226 from the dot h5 toward a h6, for example.

That is, the second side portion 226*b* of the body 226 may include the section, in which a distance from the lateral surface portion 212 of the rotating filter 210, surrounding the second area a2, gradually increases and then decreases further toward the first outlet 224 from the dot h4 to the dot h6, i.e., the section between the dot h4 to the dot h6.

Accordingly, the second area a2 may have a space for collecting foreign substances s and may become greater than the first area a1.

The embodiments are described above with reference to a number of illustrative embodiments thereof. However, the present disclosure is not intended to limit the embodiments and drawings set forth herein, and numerous other modifications and embodiments can be devised by one skilled in the art without departing from the technical spirit of the disclosure. Further, the effects and predictable effects based on the configurations in the disclosure are to be included within the range of the disclosure though not explicitly described in the description of the embodiments.

[Description of Reference Numerals]

1: Dishwasher
12: Tub
100: Sump
150: Washing pump
200: Automatic cleaning filter
210: Rotating filter
212: Lateral surface portion
220: Inlet guide
222: First inlet
224: First outlet
226: Body
230: Filter housing
232: Housing wall
234: Second outlet
236: Discharged opening
240: Water supply portion
242: Washing nozzle
250: Filter
260: Flow partition
262a: First side portion
262b: Second side portion
270: Driver

What is claimed is:

1. A dishwasher comprising:

a tub defining a washing space configured to accommodate a cooking vessel;

a sump disposed under the washing space and configured to receive a washing liquid;

an automatic cleaning filter disposed in the sump; and a washing pump connected to the sump and configured to supply the washing liquid to a plurality of spray arms, wherein the automatic cleaning filter comprises:

a rotating filter defining a plurality of first holes and having a lateral surface portion that surrounds a predetermined vacant space defined within the rotating filter;

an inlet guide comprising a first inlet configured to receive the washing liquid including foreign substances, a first outlet in fluid communication with the first inlet and that discharges the washing liquid including foreign substances into the rotating filter, and a body connecting the first inlet and the first outlet;

a filter housing disposed outside the rotating filter, wherein the filter housing comprises a housing wall surrounding the lateral surface portion of the rotating filter and a second outlet that passes through the housing wall from which the washing liquid is discharged, wherein the rotating filter is configured to filter the foreign substances in the washing liquid; and a driver configured to rotate the rotating filter, wherein the rotating filter is configured to rotate in a first direction with respect to the inlet guide and the filter housing, wherein the first outlet is configured to direct the washing liquid toward a part of an inner circumferential surface of the lateral surface portion in a predetermined direction, wherein the predetermined vacant space is configured to receive at least a portion of the washing liquid flowing along the inner circumferential surface of the lateral surface portion in a direction opposite to the first direction of the rotating filter, and wherein a horizontal component of the predetermined direction and a horizontal component of a direction from the first outlet to the second outlet form a predetermined angle greater than 0 degrees.

2. The dishwasher of claim 1, wherein the predetermined angle is greater than 90 degrees.

3. The dishwasher of claim 1, wherein the predetermined angle is 180 degrees.

4. The dishwasher of claim 1, wherein the first outlet is disposed adjacent to the part of the inner circumferential surface of the lateral surface portion.

5. The dishwasher of claim 1, wherein the rotating filter is configured to rotate around a rotation axis extended in a vertical direction, and wherein the first outlet is disposed in a direction opposite to a direction of the second outlet with respect to the rotation axis.

6. The dishwasher of claim 1, wherein the body and the first outlet of the inlet guide are at least partially disposed inside the rotating filter, and wherein the first outlet is elongated along a vertical direction and configured to direct the washing liquid toward the inner circumferential surface of the lateral surface portion.

7. The dishwasher of claim 1, wherein the housing wall of the filter housing is disposed a predetermined distance apart from an outer circumferential surface of the lateral surface portion of the rotating filter and is disposed outside the rotating filter along the outer circumferential surface of the lateral surface portion of the rotating filter.

8. The dishwasher of claim 1, wherein the predetermined vacant space inside the rotating filter is divided into a first area and a second area with respect to a virtual partition that is elongated along a vertical direction and connects the part of the inner circumferential surface of the rotating filter and the second outlet, wherein the first area is configured to receive at least a first portion of the washing liquid including foreign substances, wherein the first portion of the washing liquid flows along the inner circumferential surface of the lateral surface portion in a direction the same as a direction of rotation of the rotation filter, wherein the second area is configured to receive at least a second portion of the washing liquid including foreign substances, wherein the second portion of the washing liquid flows along the inner circumferential surface of the lateral surface portion in a direction opposite to the direction of rotation of the rotating filter, and wherein a flow partition comprising a first side portion facing the first area and a second side portion facing the second area is disposed between the first area and the second area.

9. The dishwasher of claim 8, wherein the flow partition is disposed at a position within the predetermined vacant space or has a predetermined shape, wherein the second area is greater than the first area.

10. The dishwasher of claim 8, wherein the first side portion protrudes in an outward direction toward the first area.

11. The dishwasher of claim 8, wherein the first side portion is disposed a predetermined distance apart from the inner circumferential surface of the lateral surface portion of the rotating filter along the inner circumferential surface of the lateral surface portion of the rotating filter and is disposed inside the rotating filter.

12. The dishwasher of claim 8, wherein the second side portion comprises a section in which a distance from the lateral surface portion of the rotating filter, surrounding the second area, increases and then decreases toward the first outlet or the second outlet.

13. The dishwasher of claim 8, wherein the second side portion comprises a flat surface disposed in parallel with the virtual partition.

14. The dishwasher of claim 8, wherein a portion of the flow partition, facing the second outlet, is configured to cover the second outlet entirely.

15. The dishwasher of claim 8, wherein the body and the first outlet of the inlet guide are at least partially disposed inside the rotating filter, wherein the body is elongated toward the second outlet, wherein a vacant space in the body connecting the first inlet and the first outlet extends toward the second outlet, and wherein the body corresponds to the flow partition.

16. The dishwasher of claim 1, wherein the first inlet of the inlet guide is disposed at an upper portion of the body to face an upward direction, wherein a filter is disposed on top of the first inlet, and wherein the filter comprises a plurality of second holes having a diameter greater than a diameter of a first hole of the plurality of first holes formed in the rotating filter.

17. The dishwasher of claim 1, further comprising a washing nozzle configured to spray the washing liquid toward the rotating filter, wherein the washing nozzle is disposed on the housing wall.

18. The dishwasher of claim 17, wherein the washing nozzle is disposed to face the first outlet, and to spray the washing liquid in a direction opposite to the predetermined direction faced by the first outlet.

19. The dishwasher of claim 17, wherein the washing nozzle is elongated along a vertical direction and is disposed at an outer circumferential surface of the lateral surface portion.

20. The dishwasher of claim 1, wherein the filter housing corresponds to the sump.

* * * * *